US010851486B2

(12) United States Patent
Jang et al.

(10) Patent No.: US 10,851,486 B2
(45) Date of Patent: Dec. 1, 2020

(54) WASHING MACHINE

(71) Applicant: Samsung Electronics Co., Ltd., Suwon-si (KR)

(72) Inventors: In Cheol Jang, Hwaseong-si (KR); Amitoj Singh, Haryana (IN); Hyun Sik Lee, Seongnam-si (KR); Jeoung Kyo Jeoung, Yongin-si (KR); Kang Doo Kim, Seoul (KR); Doo Young Rou, Suwon-si (KR); Seung Youp Lee, Yongin-si (KR); Ha Yong Jang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 173 days.

(21) Appl. No.: 15/756,941

(22) PCT Filed: Aug. 17, 2016

(86) PCT No.: PCT/KR2016/009018
§ 371 (c)(1),
(2) Date: Mar. 1, 2018

(87) PCT Pub. No.: WO2017/039185
PCT Pub. Date: Mar. 9, 2017

(65) Prior Publication Data

US 2018/0363192 A1 Dec. 20, 2018

(30) Foreign Application Priority Data

Sep. 1, 2015 (KR) ..... 10-2015-0123783

(51) Int. Cl.
*D06F 29/00* (2006.01)
*D06F 39/08* (2006.01)
(Continued)

(52) U.S. Cl.
CPC ..... *D06F 29/00* (2013.01); *D06F 1/04* (2013.01); *D06F 39/083* (2013.01); *D06F 39/088* (2013.01); *D06F 39/12* (2013.01)

(58) Field of Classification Search
CPC ..... D06F 1/04; D06F 29/00; D06F 39/083; D06F 39/088; D06F 39/12
See application file for complete search history.

(56) References Cited

U.S. PATENT DOCUMENTS 1,775,708 A * 9/1930 Vogan ..... D06F 1/04 68/233
1,814,698 A * 7/1931 Huber ..... D06F 1/04 68/233
(Continued)

FOREIGN PATENT DOCUMENTS

CN 1232898 A 10/1999
CN 2567225 Y 8/2003
(Continued)

OTHER PUBLICATIONS

Supplementary European Search Report dated Sep. 17, 2018 in connection with European Patent Application No. 16 84 2151, 9 pages.
(Continued)

*Primary Examiner* — Joseph L. Perrin

(57) ABSTRACT

A washing machine include a main body in which an inlet is formed in a front portion thereof; a tub provided inside the main body; a washing tub rotatably provided inside the tub; and a sink provided on the main body and having a water tank formed to be recessed to store water, wherein the water tank includes a soaking part in which laundry is soaked and a scrubbing part on which laundry is scrubbed and hand-
(Continued)

washed, the function of soaking the laundry in water and the function of hand-washing are provided and the washing effect is improved.

11 Claims, 22 Drawing Sheets

(51) Int. Cl.
*D06F 1/04* (2006.01)
*D06F 39/12* (2006.01)

(56) References Cited

U.S. PATENT DOCUMENTS 3,026,699 A * 3/1962 Rhodes ..... D06F 37/145 68/12.19
3,031,871 A * 5/1962 Bailey ..... A47L 15/00 68/13 R
3,209,560 A * 10/1965 Shelton ..... D06F 13/00 68/4
3,331,226 A * 7/1967 Fink ..... D06F 29/00 68/20
5,253,493 A * 10/1993 Ohashi ..... D06F 39/14 220/812
5,412,818 A * 5/1995 Chen ..... E03C 1/14 4/637
9,200,399 B2 12/2015 Kim et al.
2004/0168481 A1* 9/2004 Usherovich ..... D06F 25/00 68/13 R
2005/0056059 A1* 3/2005 Usherovich ..... D06F 39/14 68/12.02
2005/0072194 A1* 4/2005 Ryohke ..... D06F 19/00 68/3 R
2009/0235697 A1* 9/2009 Reid ..... B08B 3/12 68/3 SS
2010/0294004 A1* 11/2010 Hu ..... D06F 29/00 68/13 R
2015/0247274 A1* 9/2015 Kim ..... D06F 39/08 68/27

FOREIGN PATENT DOCUMENTS

CN 201864973 U 6/2011
CN 102182043 A 9/2011
DE 102005000602 A1 7/2006
EP 1681383 A1 7/2006
GB 1032241 A 6/1966
KR 2000-0000513 U 1/2000
KR 10-2005-0014546 A 2/2005
KR 10-2015-0092073 A 8/2015
WO 2015/115730 A1 8/2015

OTHER PUBLICATIONS

ISA/KR, International Search Report and Written Opinion of the International Searching Authority for International Application No. PCT/KR2016/009018, dated Nov. 15, 2016, 11 pages.
The First Office Action in connection with Chinese Application No. 201680050679.2 dated Feb. 6, 2020, 15 pages.
Office Action dated Jul. 17, 2020 in connection with Chinese Patent Application No. 201680050679.2, 17 pages.
Office Action dated Oct. 23, 2020 in connection with Chinese Patent Application No. 201680050679.2, 17 pages.

* cited by examiner

【Fig. 1】
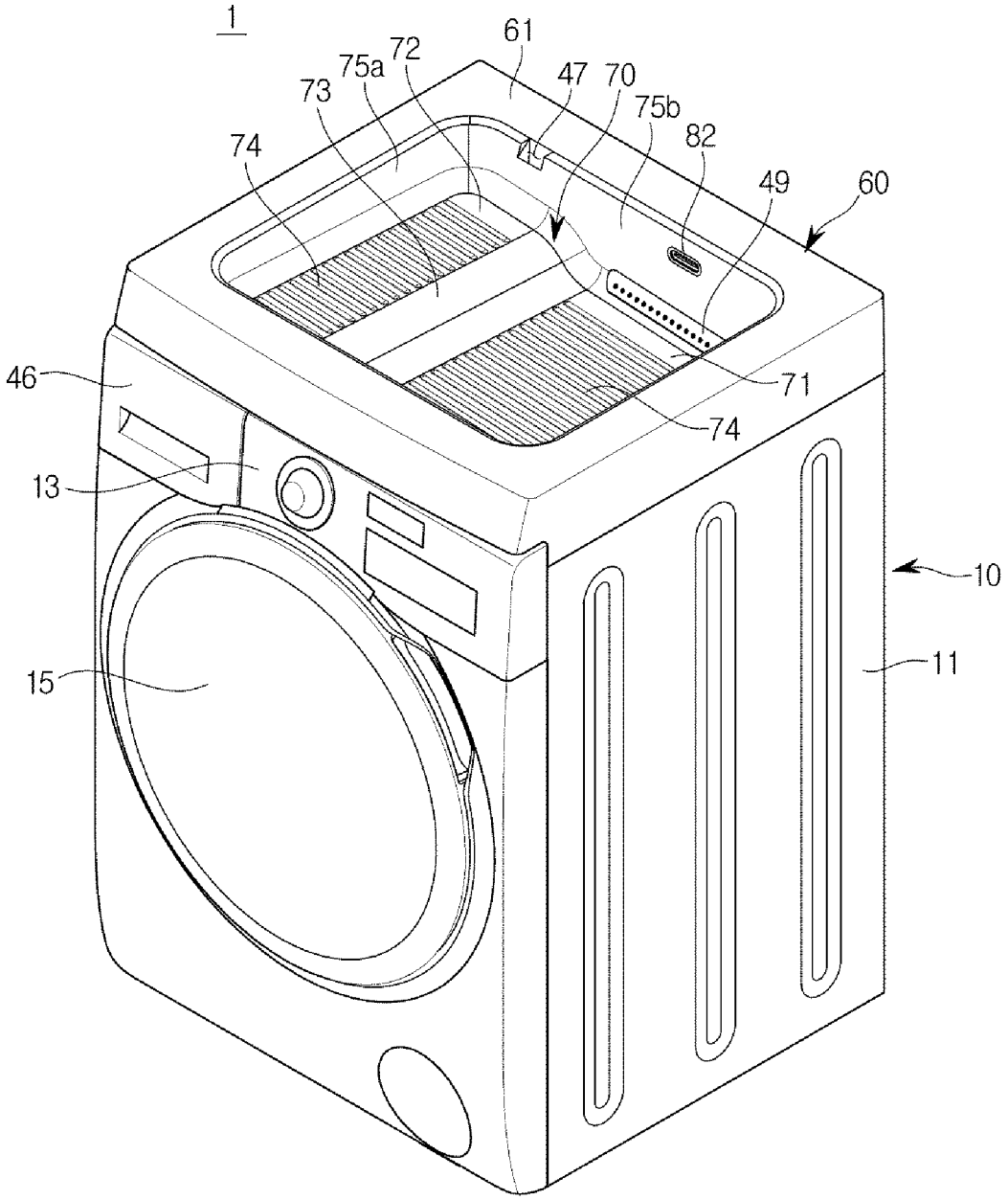

【Fig. 2】
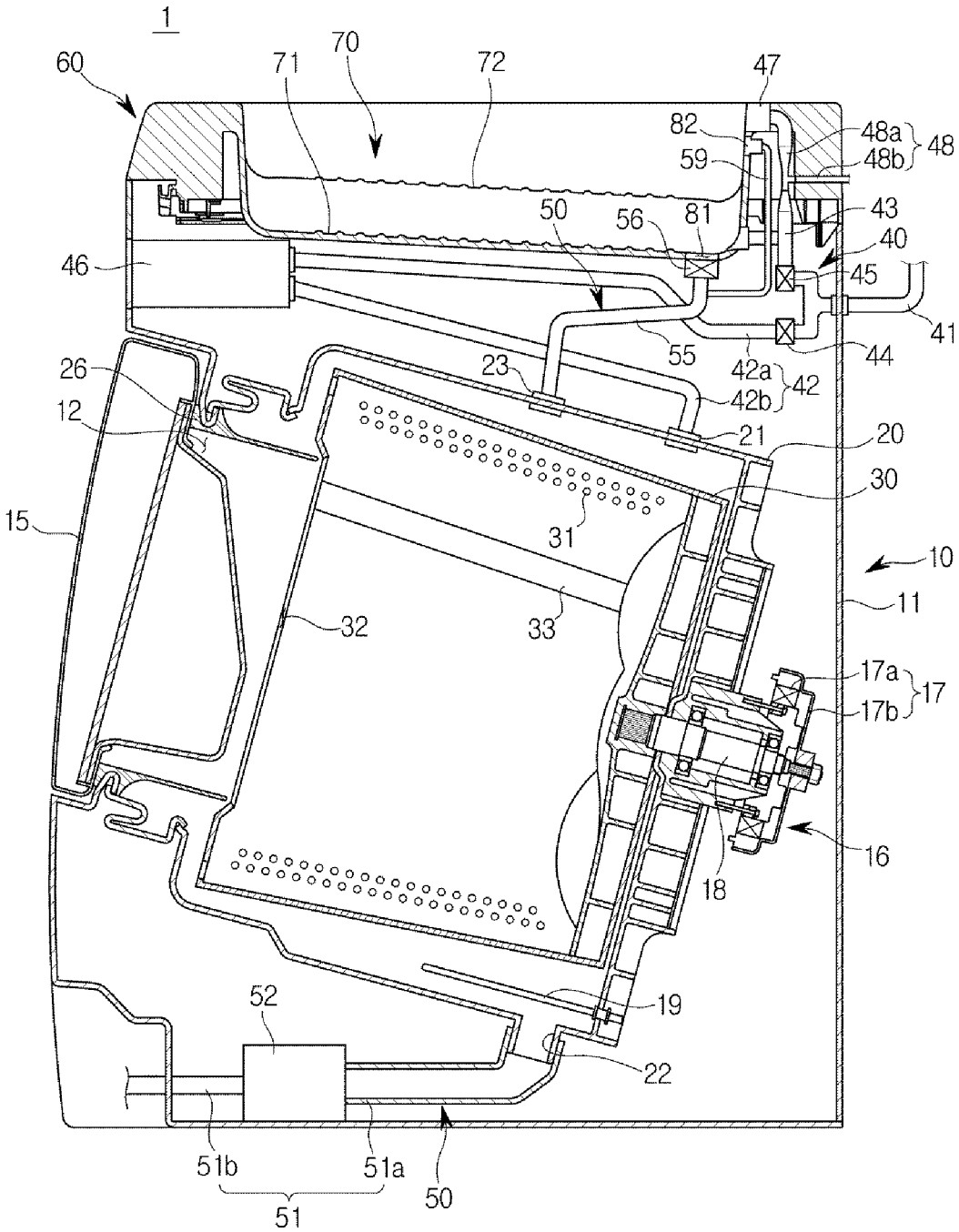

【Fig. 3】
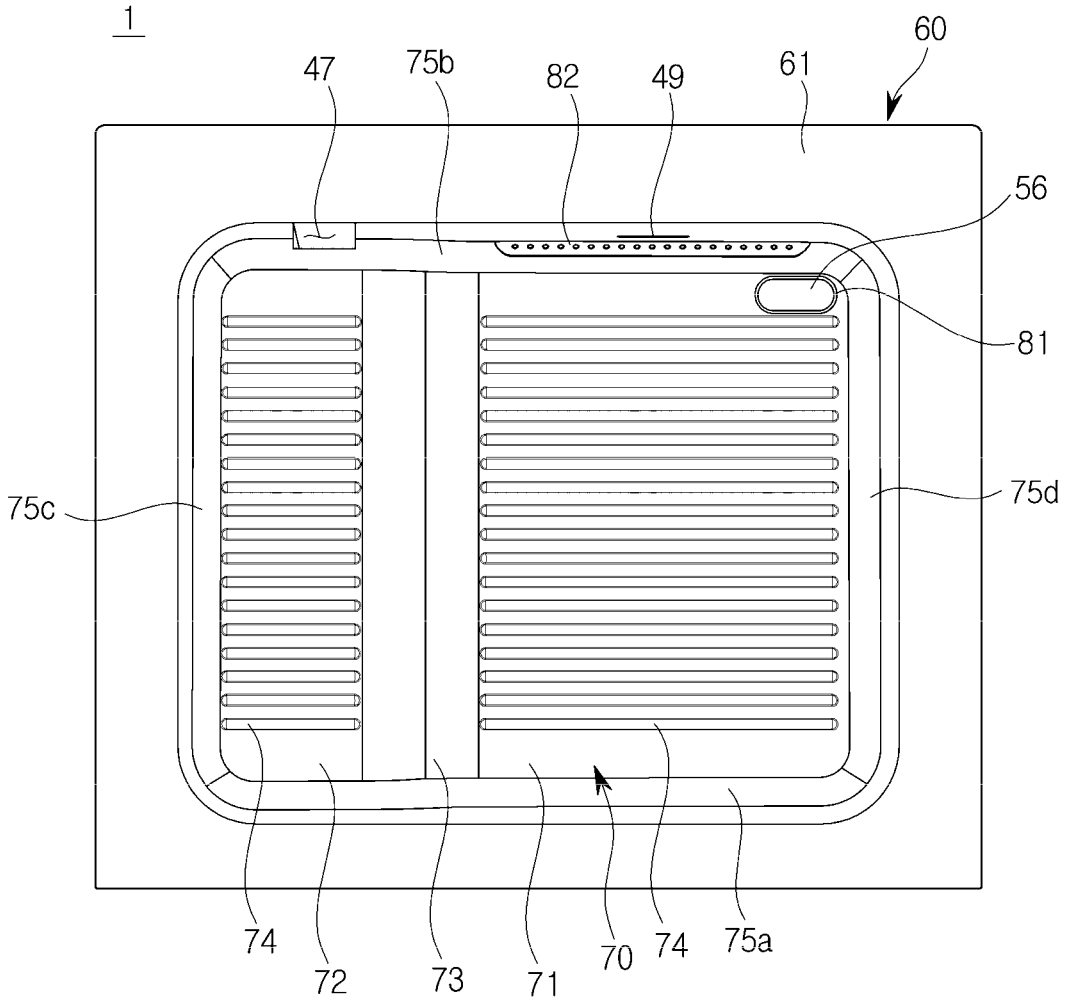

【Fig. 4】
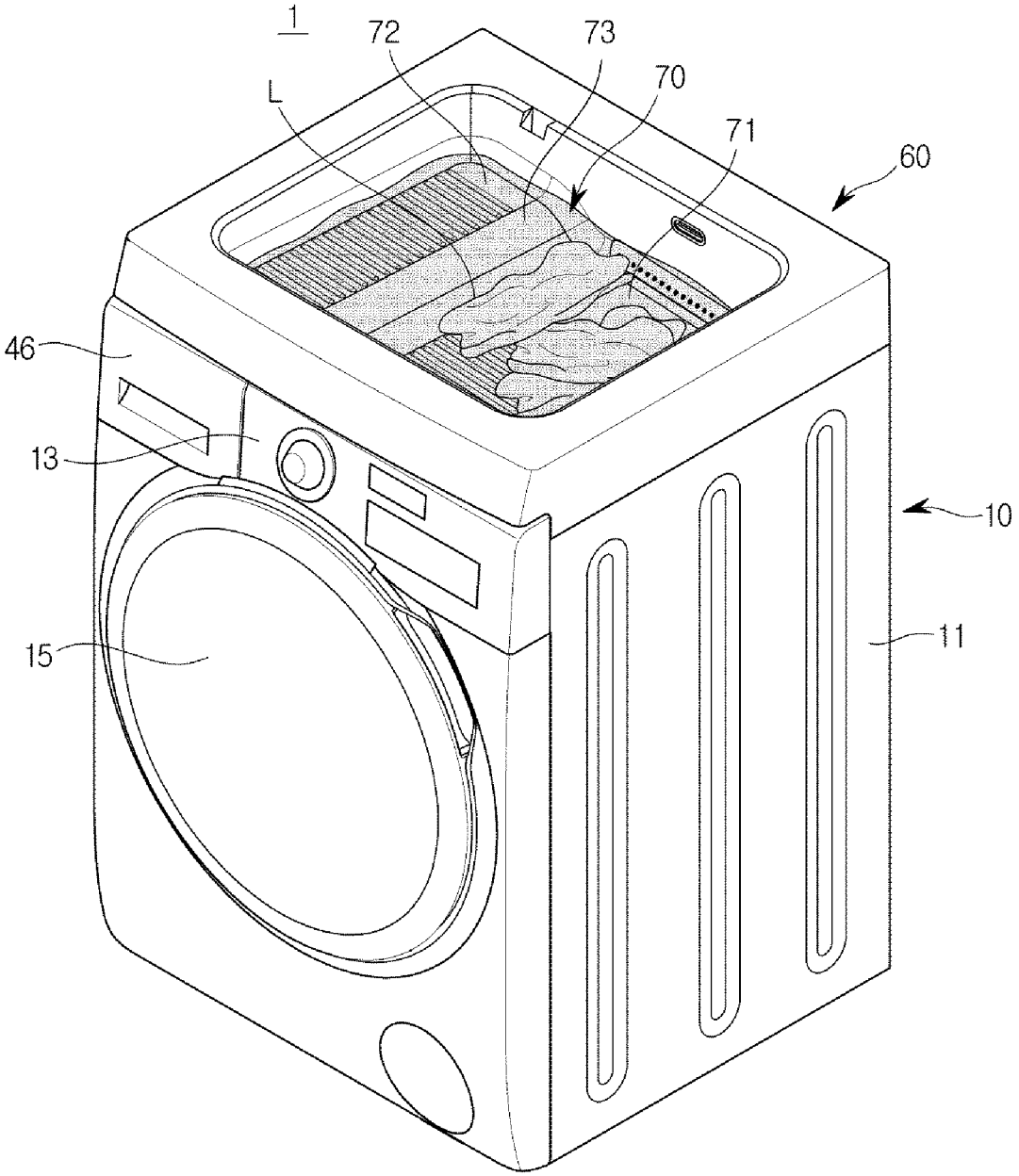

【Fig. 5】
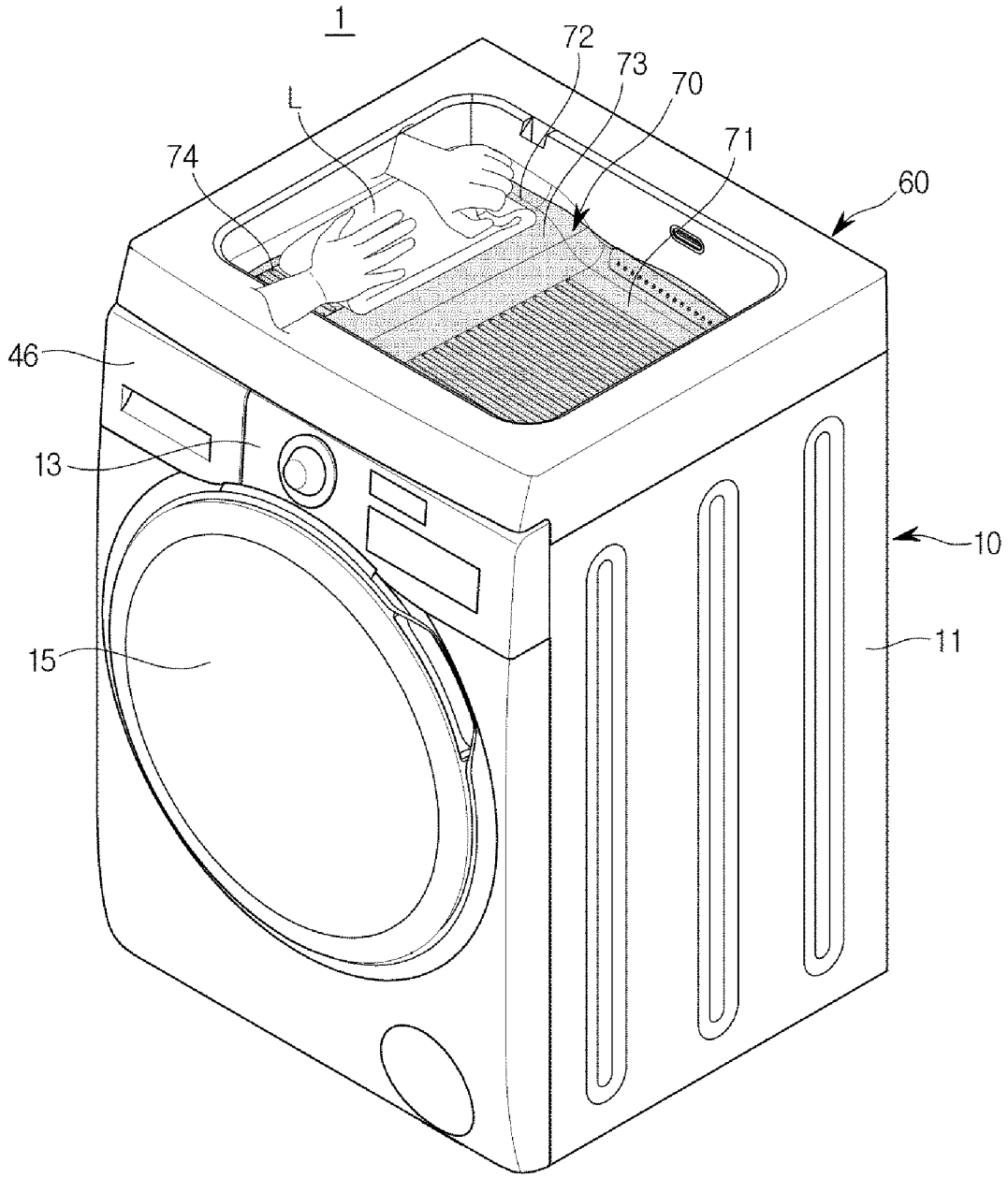

【Fig. 6】
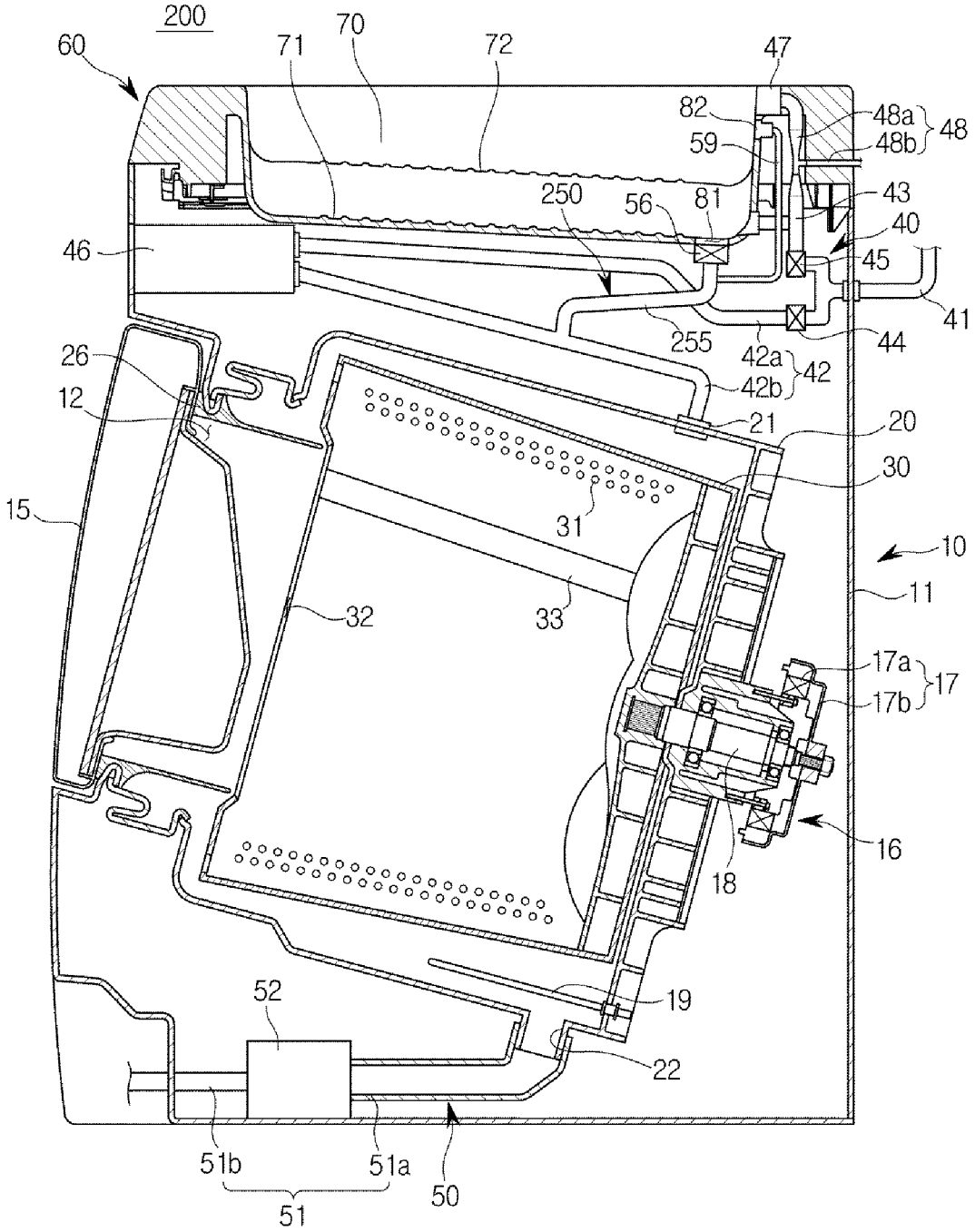

【Fig. 7】
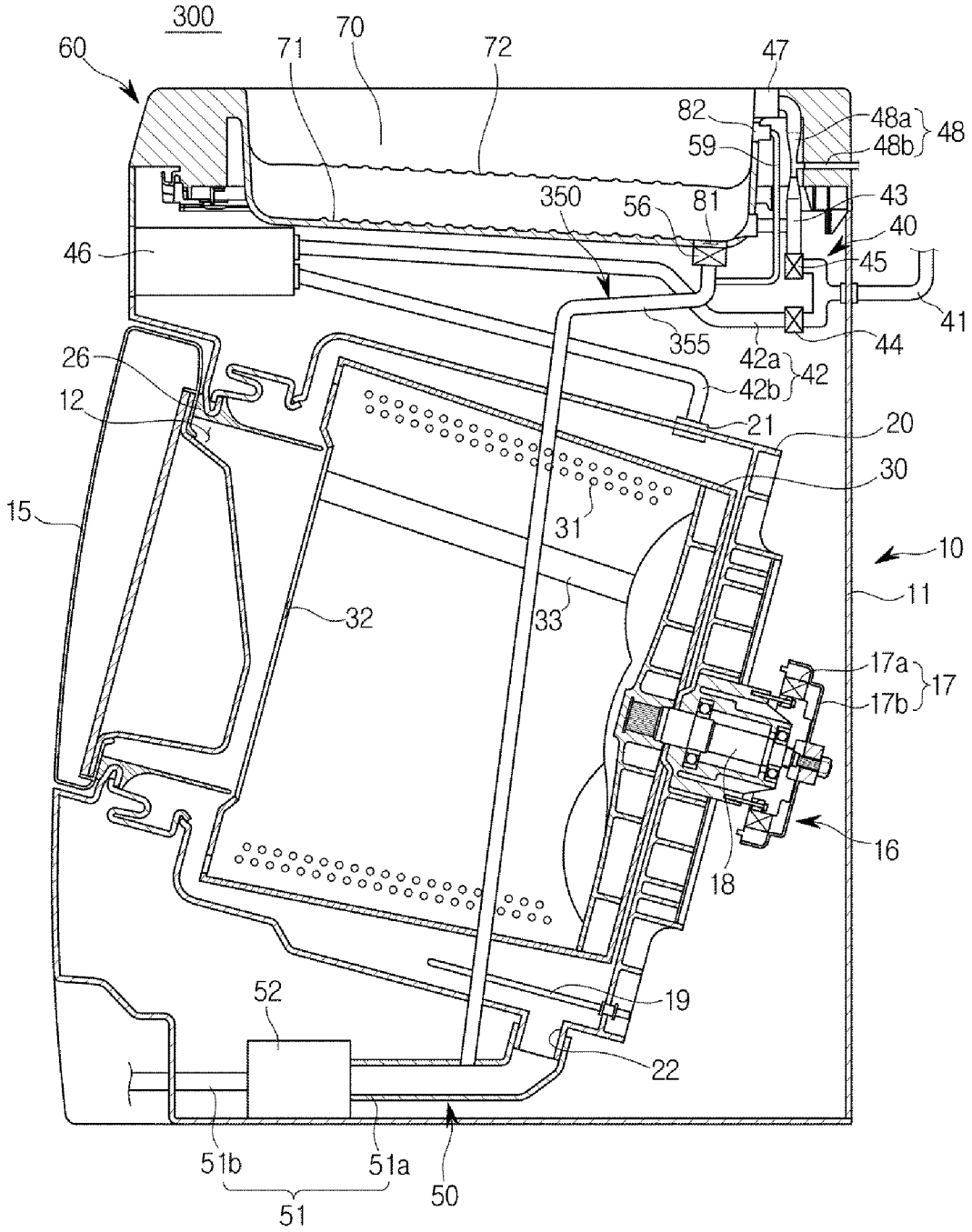

【Fig. 8】
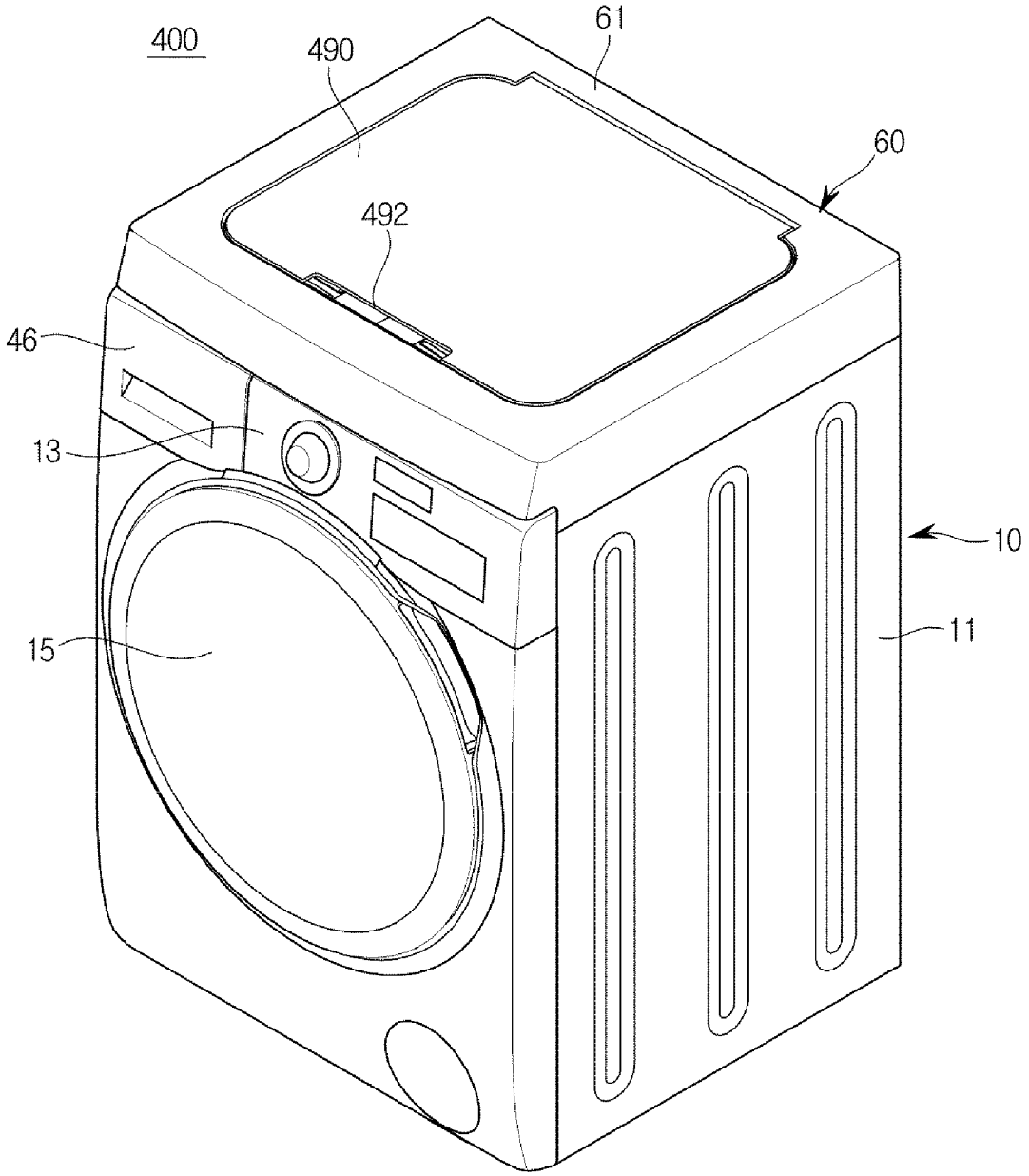

【Fig. 9】
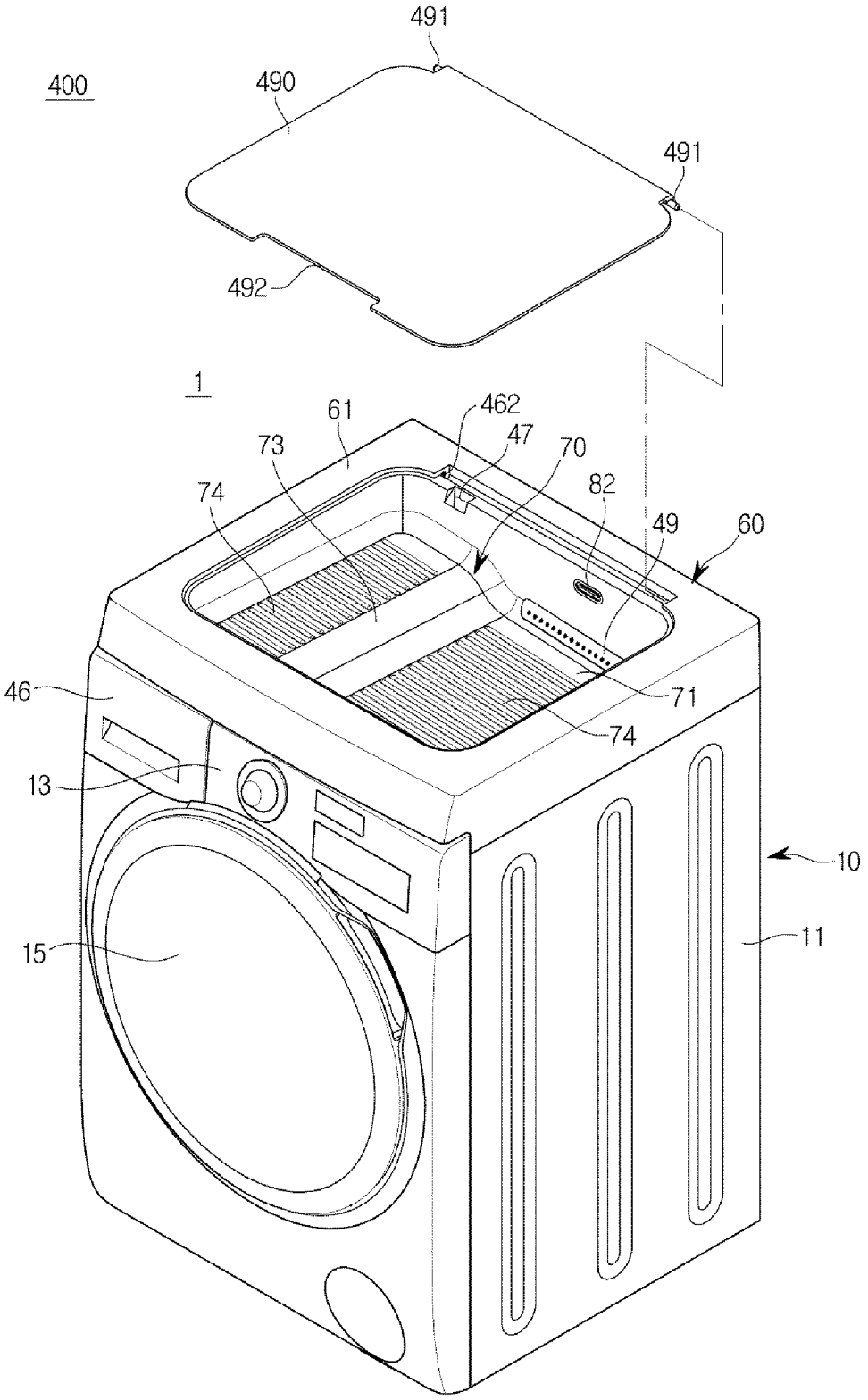

【Fig. 10】
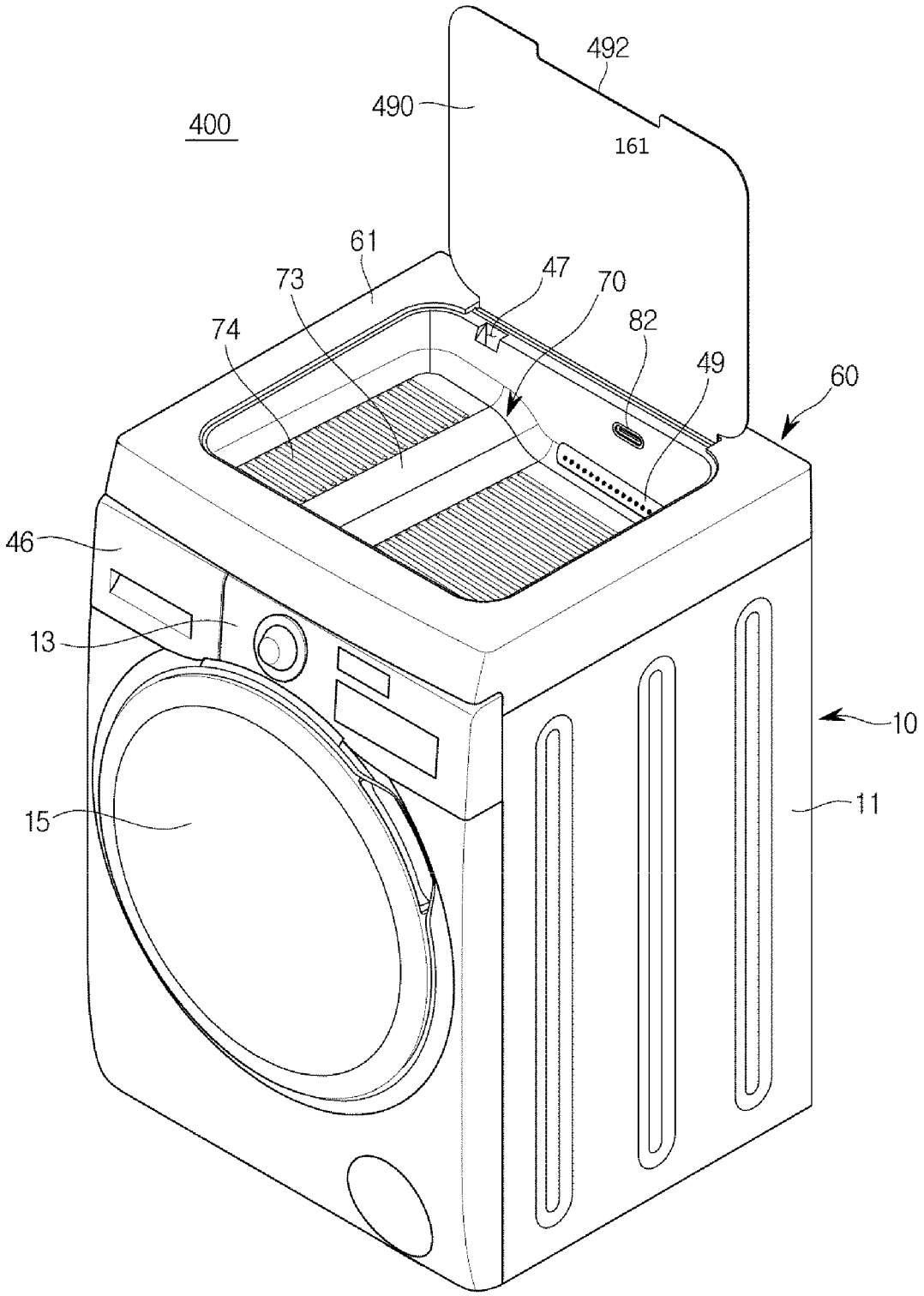

【Fig. 11】
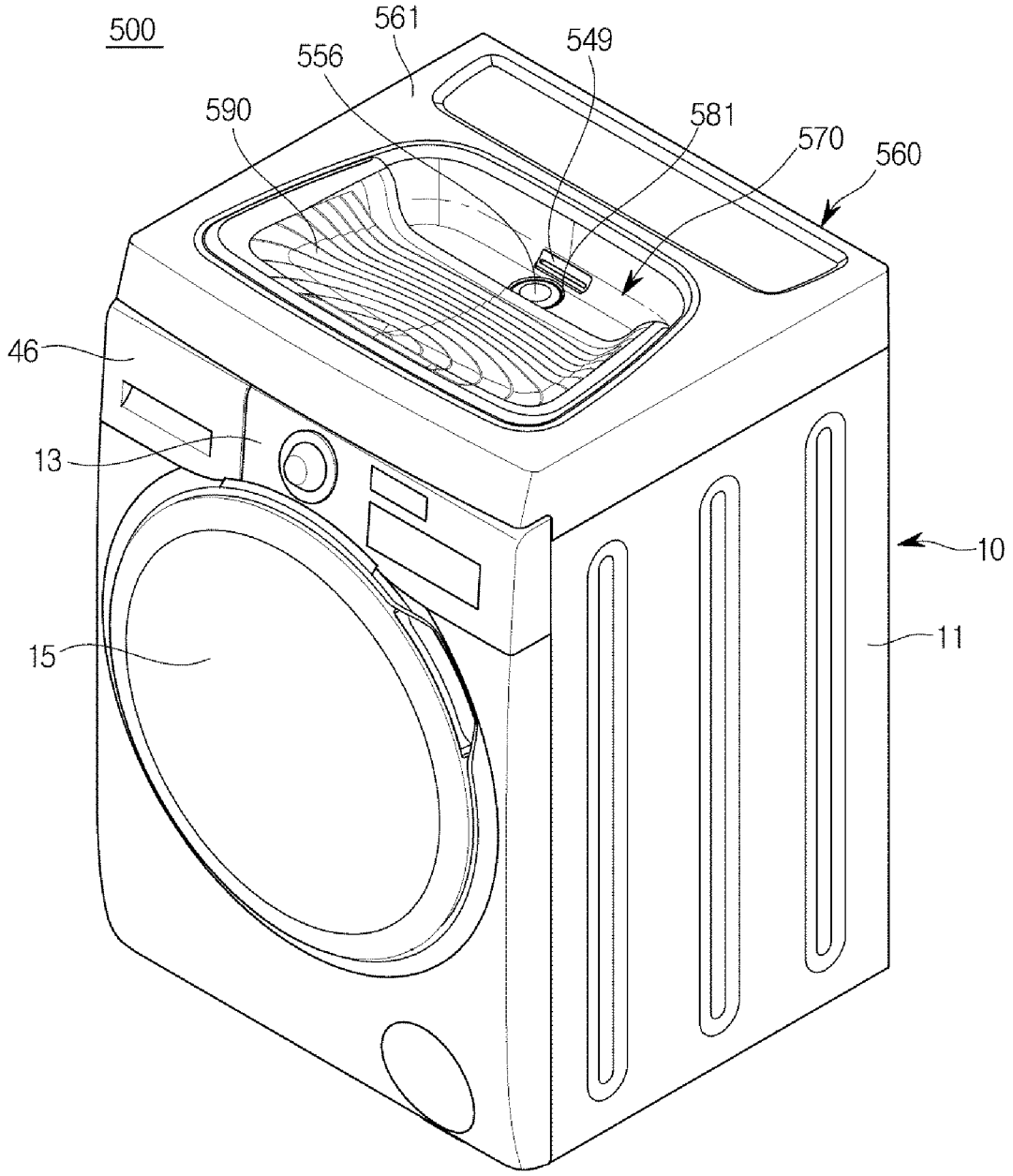

【Fig. 12】
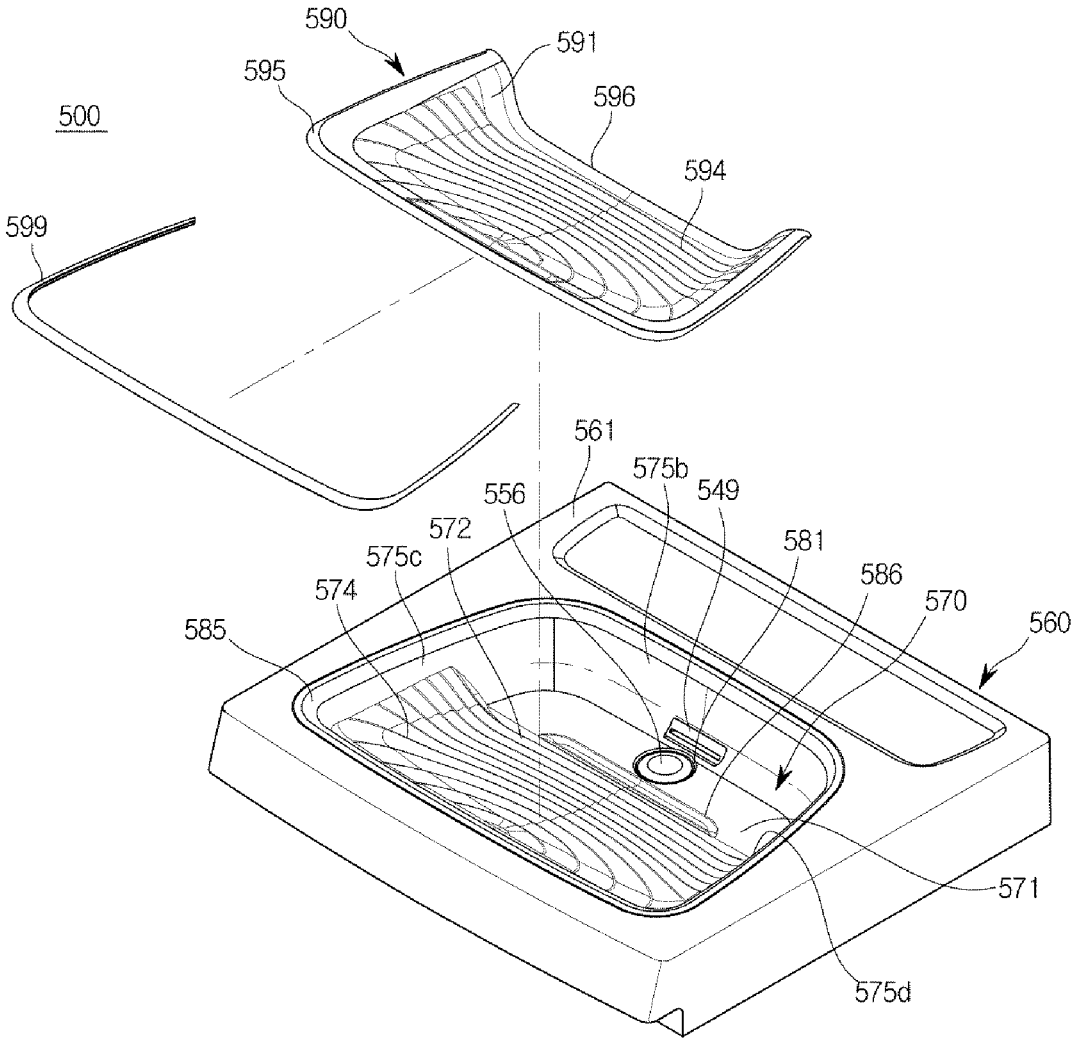

【Fig. 13】
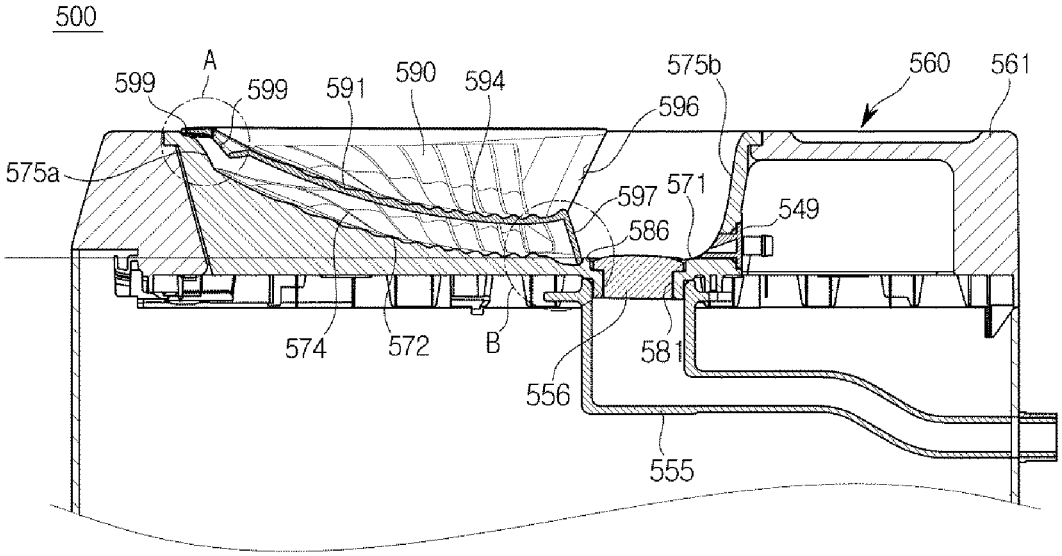

【Fig. 14】
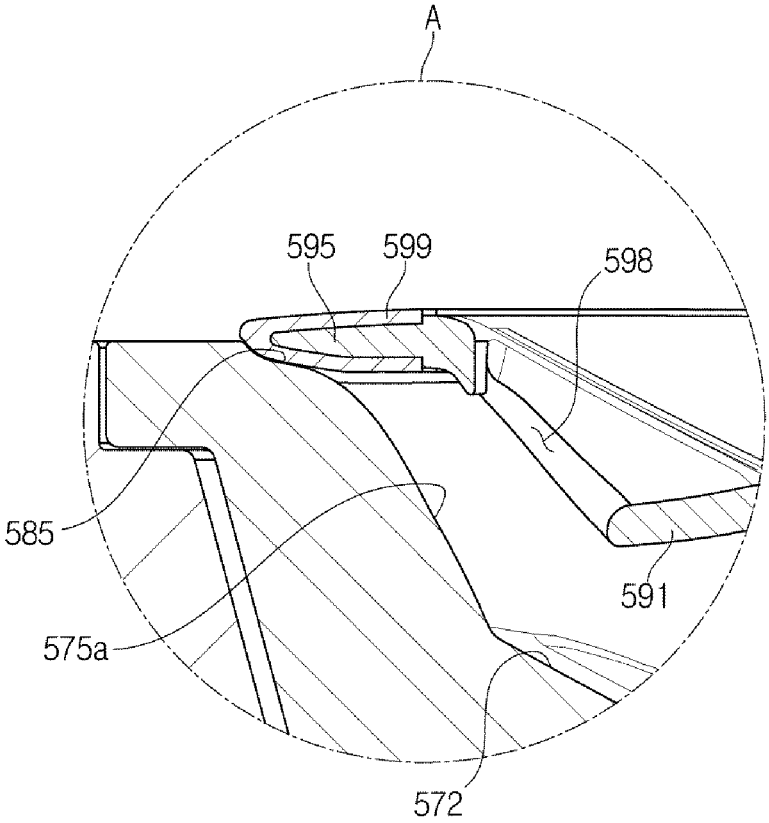

【Fig. 15】
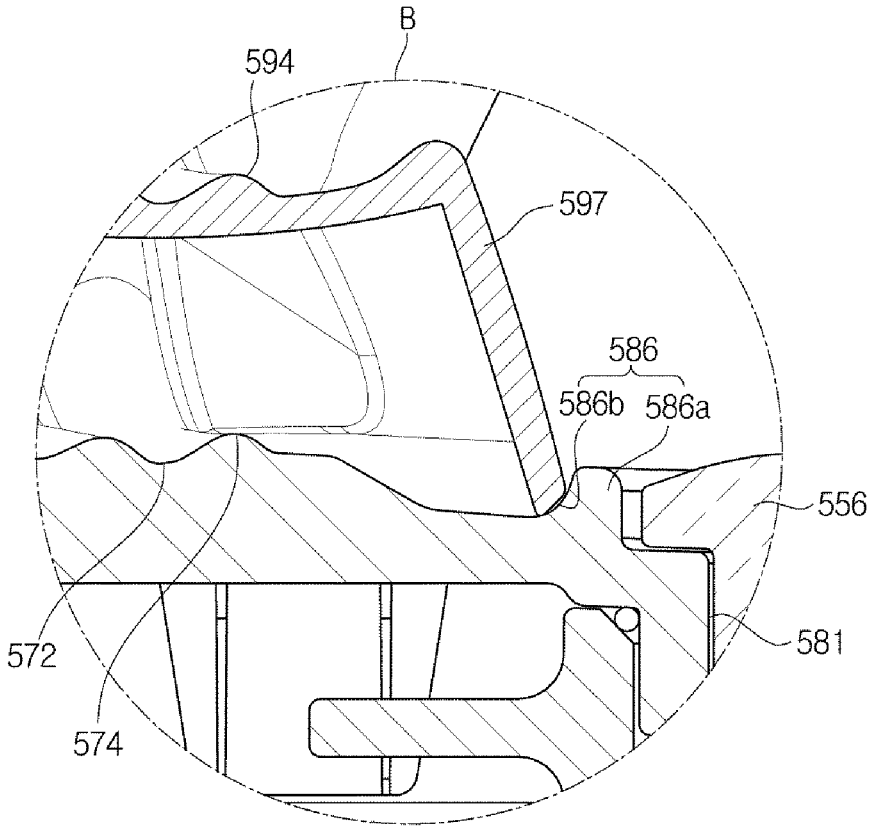

【Fig. 16】
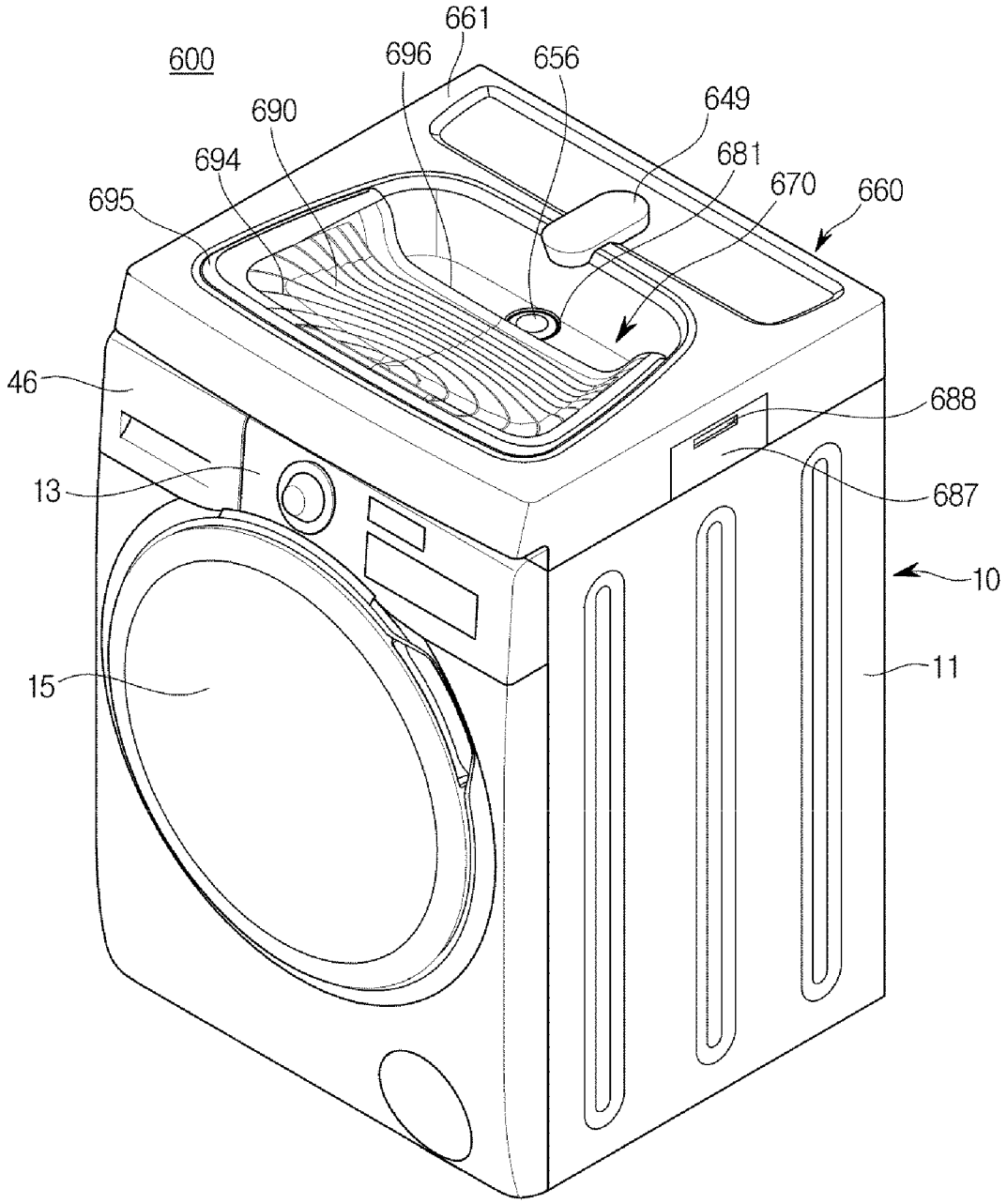

【Fig. 17】
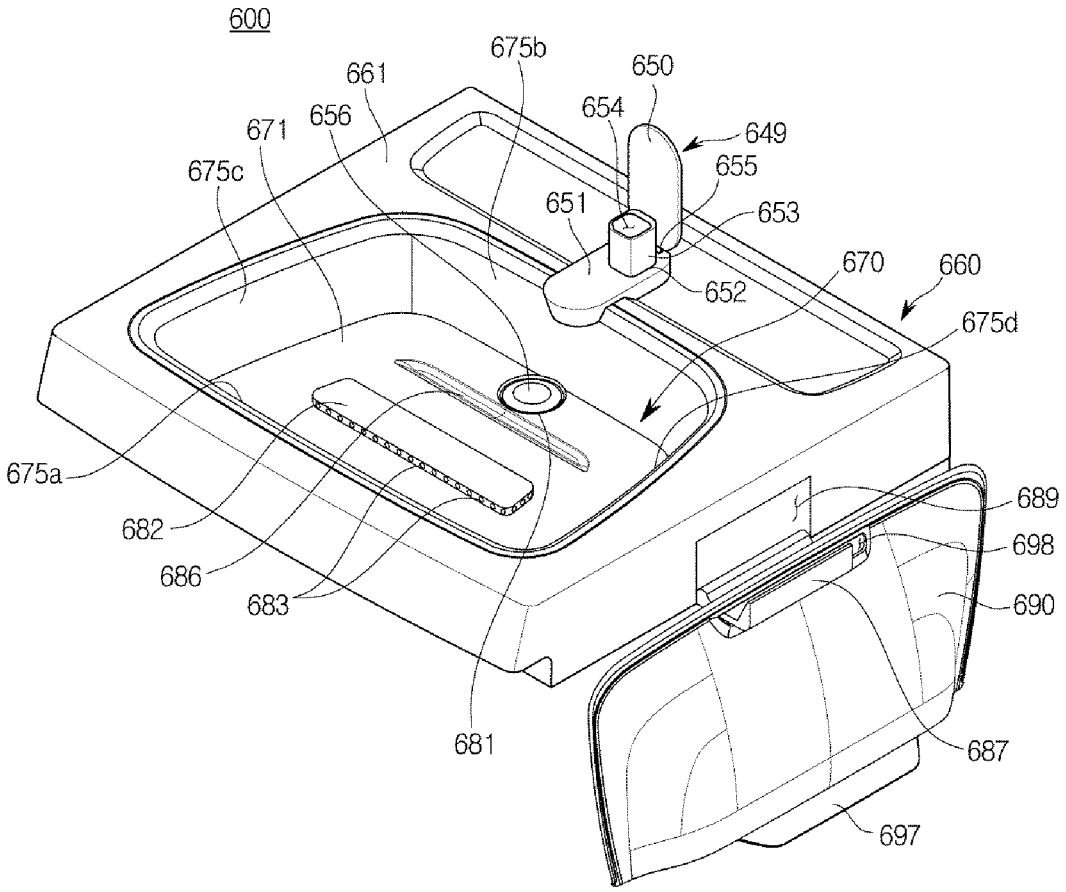

【Fig. 18】
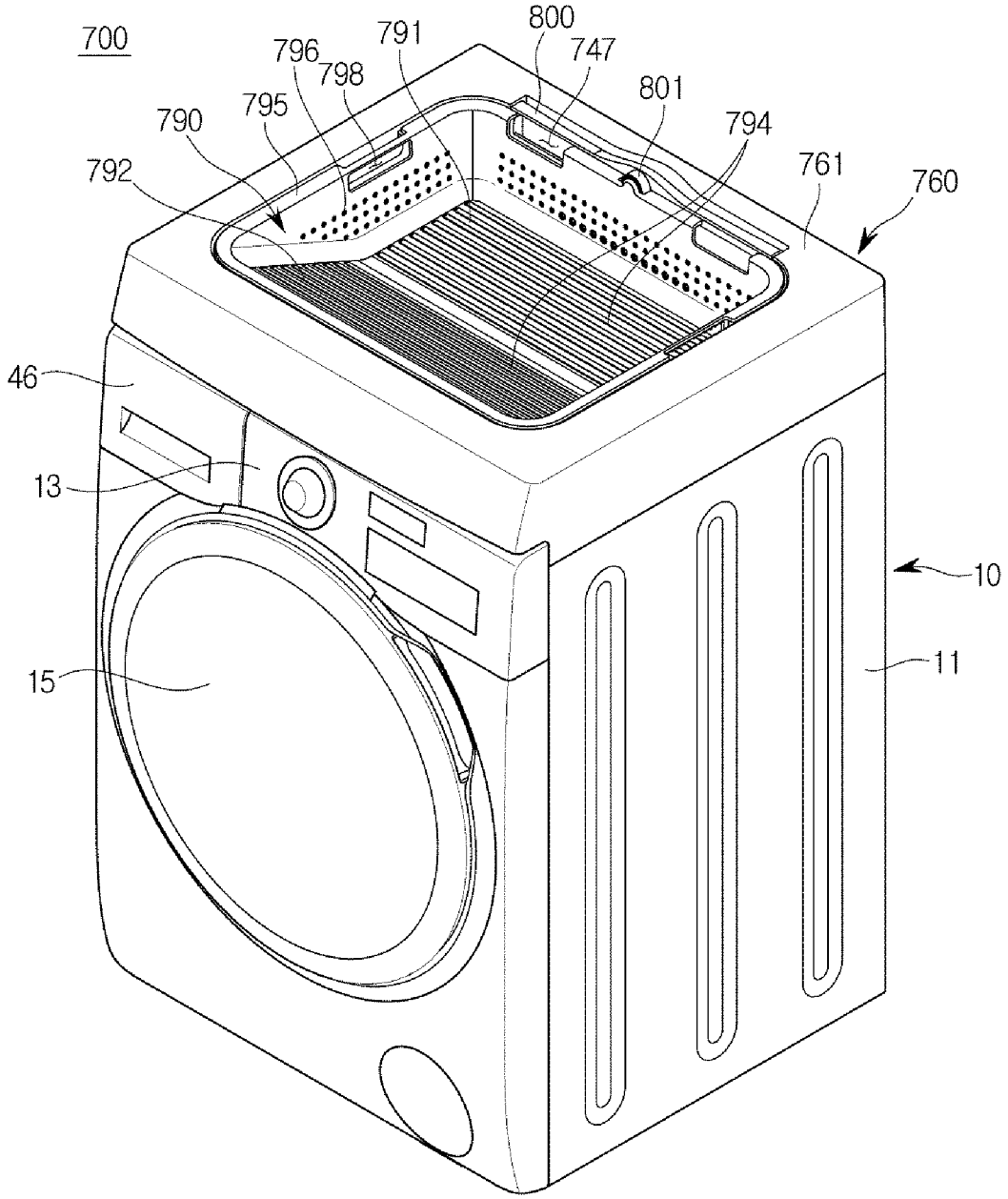

【Fig. 19】
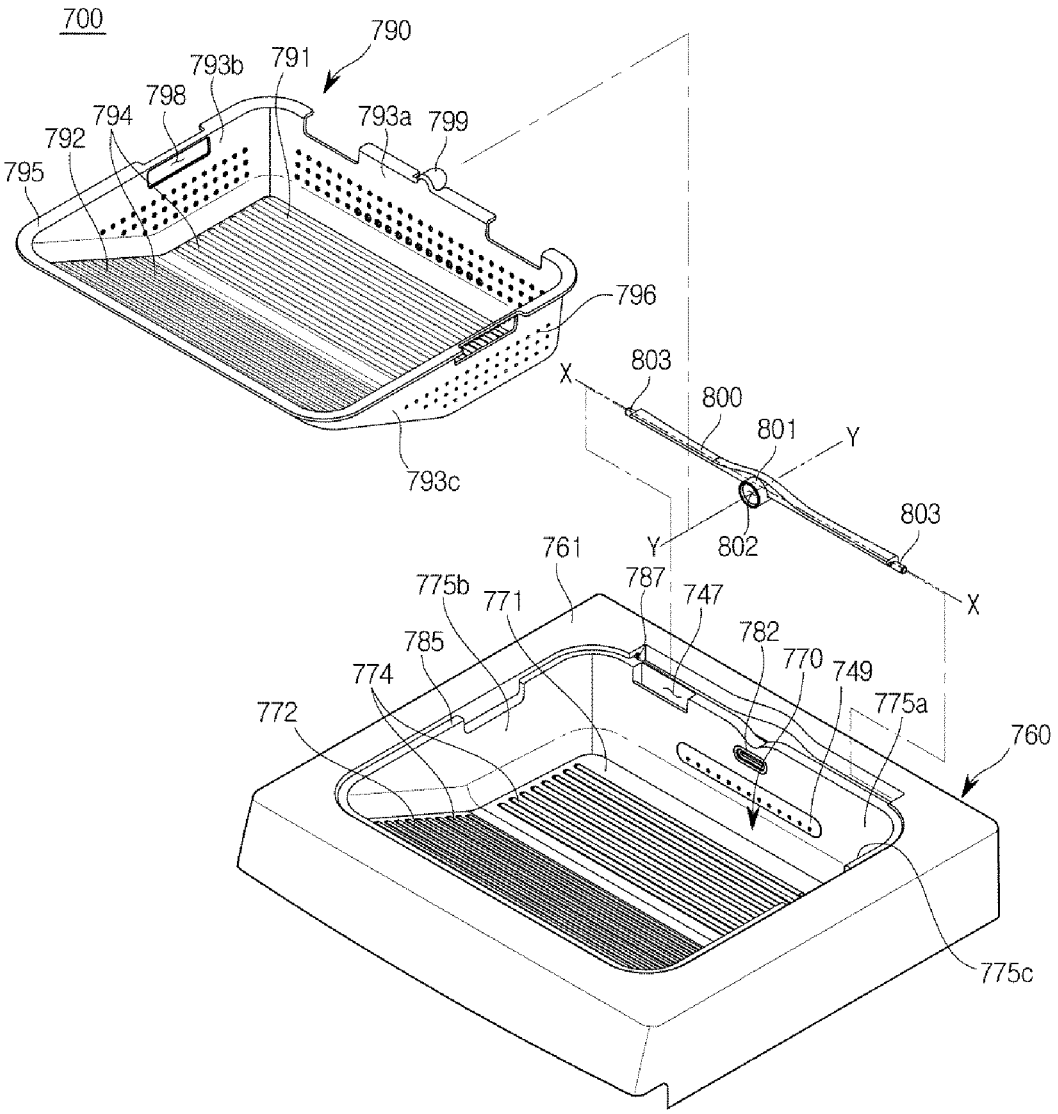

【Fig. 20】
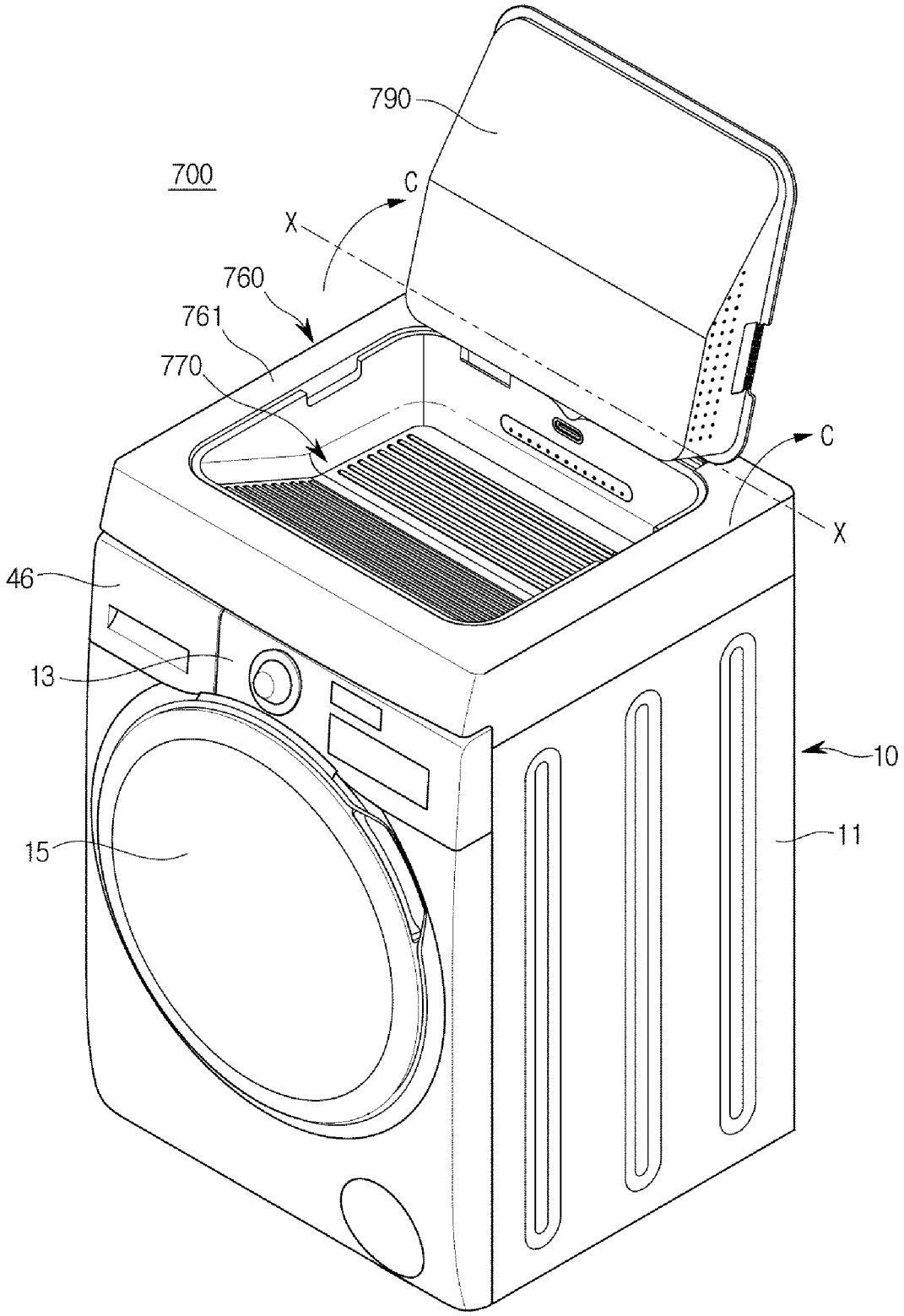

【Fig. 21】
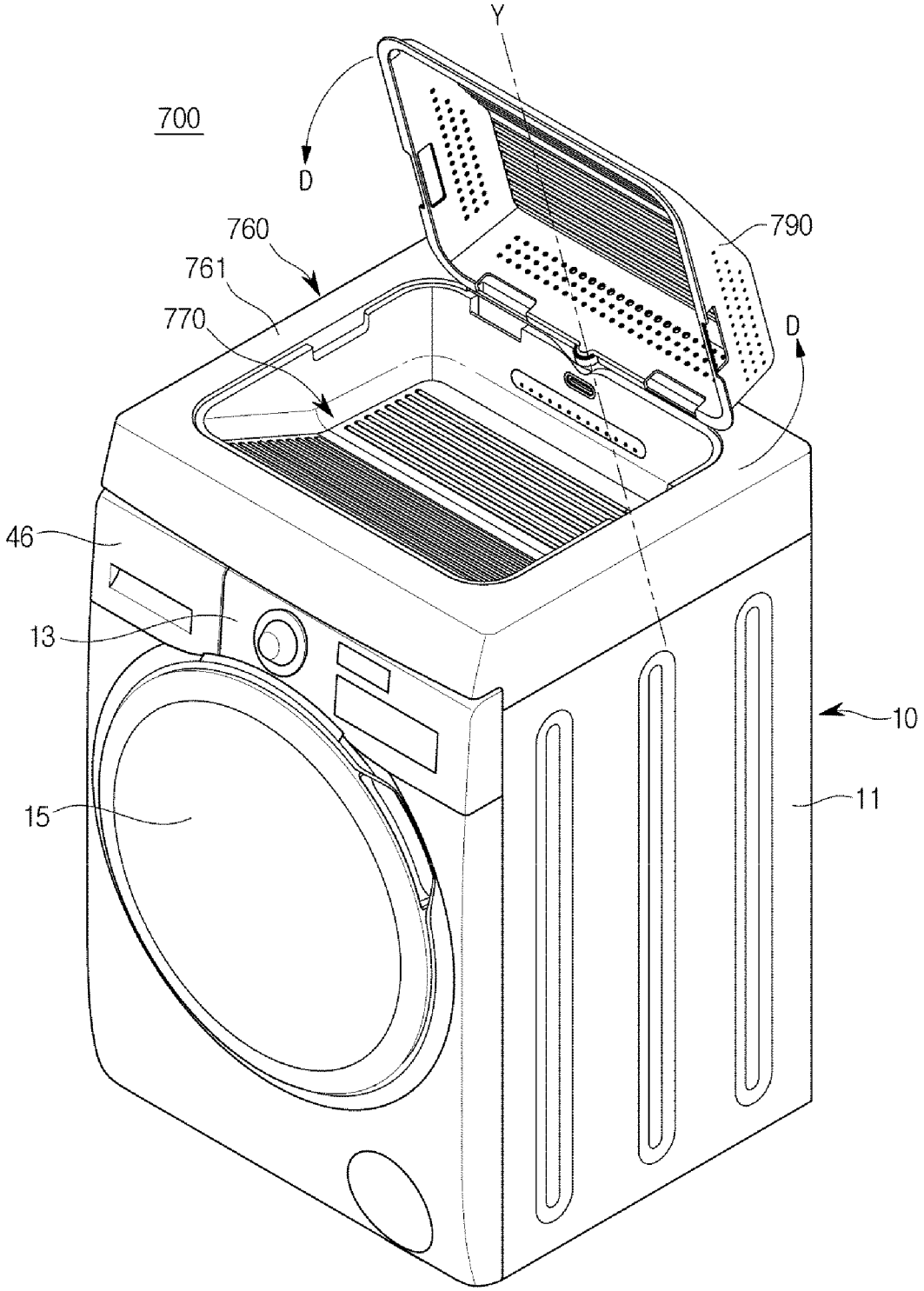

【Fig. 22】
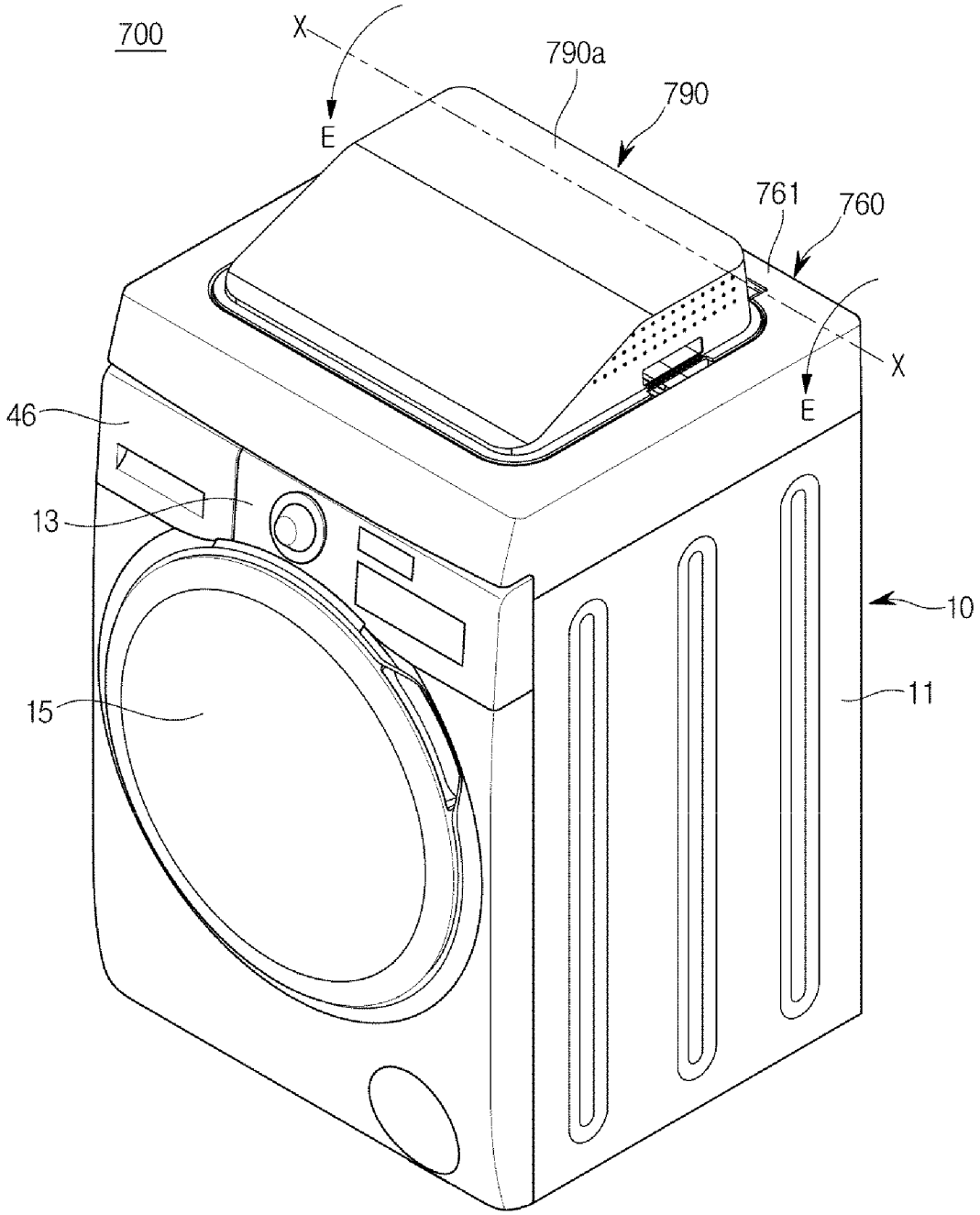

WASHING MACHINE

CROSS-REFERENCE TO RELATED APPLICATIONS AND CLAIM OF PRIORITY

This application is a 371 National Stage of International Application No. PCT/KR2016/009018, filed Aug. 17, 2016, which claims priority of Korean Patent Application No. 10-2015-0123783, filed Sep. 1, 2015, the disclosures of which are herein incorporated by reference in their entirety.

TECHNICAL FIELD

The present disclosure relates to a washing machine, and more particularly, to a washing machine in which a sink is integrally provided.

BACKGROUND

Washing machines are household appliances configured to wash clothes using power and include a tub configured to accommodate washing water, a rotating tub rotatably installed in the tub, and a driver configured to rotate the rotating tub to mechanically wash laundry.

Washing machines can be classified into agitator type washing machines, pulsator type washing machines, and drum type washing machines according to washing methods. An agitator type washing machine washes laundry by laterally rotating an agitator protruding from a central portion of a washing tub. A pulsator type washing machine rotates a pulsator formed on a lower portion of a rotating tub and having a disk shape to generate a flow of water so that laundry is washed by the generated flow of the water. The drum type washing machine uses a lifter formed on an inner circumferential surface of a drum to lift and drop laundry so that the laundry is washed.

Generally, the agitator type washing machine and the pulsator type washing machine are top loading type washing machines in which laundry is put into the washing machine from above, and the drum washing machine is a front loading type washing machine in which laundry is put into the washing machine from the front.

Although a washing machine mechanically washes laundry and provides convenience to a user, stained dirt, a local stain, or the like may not be completely washed by the mechanical washing. Accordingly, the washing machine can include a sink so that the user can directly hand-wash laundry.

However, the sink generally includes only a sink provided in a kitchen or a sink provided in a lavatory applied to the washing machine, and has only minor differences in configuration and function therebetween, and accordingly, efficiency and convenience for washing using the sink is low.

SUMMARY

The present disclosure is directed to providing a washing machine including a sink for providing hand-washing and soaking functions.

In addition, the present disclosure is directed to providing a washing machine for providing convenience when laundry is put into a washing tub for main washing after washing and soaking processes are performed on the laundry.

In accordance with an aspect of the present disclosure, a washing machine include a main body in which an inlet is formed in a front portion thereof; a tub provided inside the main body; a washing tub rotatably provided inside the tub; and a sink provided on the main body and having a water tank formed to be recessed to store water, wherein the water tank includes a soaking part in which laundry is soaked and a scrubbing part on which laundry is scrubbed and hand-washed.

The soaking part may be located at a lower level than the scrubbing part.

The scrubbing part may be formed to be inclined.

The scrubbing part may be downwardly inclined from a front side of the main body to a rear side of the main body.

In accordance with another aspect of the present disclosure, a washing machine includes a main body in which an inlet is formed in a front portion thereof; a tub provided inside the main body; a washing tub rotatably provided inside the tub; a sink provided on the main body and having a water tank formed to be recessed to store water; and a tray detachably mounted on the sink such that laundry washed in the sink is moved to the inlet.

According to an aspect of the present disclosure, hand-washing and soaking can easily and efficiently be performed on laundry before main washing is performed on the laundry.

According to another aspect of the present disclosure, when laundry hand-washed and soaked in a sink is put into a washing tub for main washing, convenience of a user can be improved.

BRIEF DESCRIPTION OF THE DRAWINGS

FIG. 1 is a perspective view illustrating a washing machine according to a first embodiment of the present disclosure.

FIG. 2 is a side sectional view illustrating a schematic configuration of the washing machine in FIG. 1.

FIG. 3 is a plan view of a sink of the washing machine in FIG. 1.

FIG. 4 is a view illustrating a soak-washing process using a soaking part of the washing machine in FIG. 1.

FIG. 5 is a view illustrating a hand-washing process using a scrubbing part of the washing machine in FIG. 1.

FIG. 6 is a side sectional view illustrating a schematic configuration of a washing machine according to a second embodiment of the present disclosure.

FIG. 7 is a side sectional view illustrating a schematic configuration of a washing machine according to a third embodiment of the present disclosure.

FIG. 8 is a perspective view illustrating a washing machine according to a fourth embodiment of the present disclosure.

FIG. 9 is a view illustrating a sink cover separated from the washing machine in FIG. 8.

FIG. 10 is a view illustrating an open state of the sink cover of the washing machine in FIG. 8.

FIG. 11 is a perspective view illustrating an exterior of a washing machine according to a fifth embodiment of the present disclosure.

FIG. 12 is a view illustrating a tray separated from the washing machine in FIG. 11.

FIG. 13 is a side sectional view illustrating a sink and the tray of the washing machine in FIG. 11.

FIG. 14 is an enlarged view illustrating portion A in FIG. 13.

FIG. 15 is an enlarged view illustrating portion B in FIG. 13.

FIG. 16 is a perspective view illustrating an exterior of a washing machine according to a sixth embodiment of the present disclosure.

FIG. 17 is a view illustrating a state in which a tray of the washing machine in FIG. 16 is mounted on a tray holder and a water tap is opened.

FIG. 18 is a perspective view illustrating a washing machine according to a seventh embodiment of the present disclosure.

FIG. 19 is a view illustrating a tray and a guide member separated from the washing machine in FIG. 18.

FIGS. 20 to 22 are views illustrating a rotating operation of the tray of the washing machine in FIG. 18.

DETAILED DESCRIPTION

Since embodiments described in the specification are merely exemplary examples of the present disclosure and do not entirely represent aspects of the present disclosure, various equivalents and modifications capable of replacing the embodiments of the present disclosure at the time of filing of the present application may be understood as being included in the scope of the present disclosure.

The same elements in each of the drawings may have the same reference numerals, and each of the drawings may be shown to be enlarged or somewhat exaggerated to facilitate easy understanding of the present disclosure.

Unless separately defined in this specification, terms used herein including technical terms or scientific terms have the same meanings as understood by those skilled in the art.

However, the terms used in this specification are not to be understood as restricted to the ordinary or dictionary meanings, and should be understood as including meanings and concepts corresponding to aspects of the present disclosure on the basis of the principle that the inventor suitably defines the terms to describe the present disclosure in the best way.

It should be understood that, although the terms "first," "second," and the like may be used herein to describe various elements, the elements are not restricted by the terms. That is, the terms are only used to distinguish one element from another.

As used herein, the singular forms "a," "an," and "the" are intended to include the plural forms as well, unless otherwise contextually or apparently indicated otherwise.

It should be further understood that the terms "include," "including," "have," and/or "having" indicate the presence of stated elements, features, integers, steps, operations, and/or groups thereof, but do not exclude the presence or addition of one or more other elements, features, integers, steps, operations, and/or groups thereof.

A case in which "frontward," "rearward," "upward," "downward," "on the left side," or "on the right side" are simply indicated may include a case in which one element is provided "in front of," "behind," "above," "below," "on the left side of" or "on the right side of" another element and does not exclude a case in which still another element is interposed between the two elements.

Hereinafter, the embodiments according to the present disclosure will be described in detail with reference to the accompanying drawings.

First Embodiment

FIG. 1 is a perspective view illustrating a washing machine according to a first embodiment of the present disclosure. FIG. 2 is a side sectional view illustrating a schematic configuration of the washing machine in FIG. 1. FIG. 3 is a plan view of a sink of the washing machine in FIG. 1. FIG. 4 is a view illustrating a soak-washing process using a soaking part of the washing machine in FIG. 1. FIG. 5 is a view illustrating a hand-washing process using a scrubbing part of the washing machine in FIG. 1.

The washing machine according to the first embodiment of the present disclosure will be described in detail with reference to FIGS. 1 to 5.

A washing machine 1 includes a main body 10, a tub 20 provided in the main body 10 and configured to store washing water, a washing tub 30 rotatably provided in the tub 20 and configured to accommodate laundry, a driver 16 configured to rotate the washing tub 30, and a sink 60 provided on the main body 10.

The main body 10 includes a cabinet 11 having an approximate box shape, configured to accommodate and protect various components mounted therein, and forming an exterior of the washing machine 1. Although the sink 60 is provided directly on the cabinet 11 in the embodiment, a top cover may be provided between the cabinet 11 and the sink 60 unlike the embodiment.

An inlet 12 allowing the laundry to be put into the washing tub 30 is formed in a front surface of the cabinet 11. That is, the washing machine 1 may be a front loading type washing machine. The inlet 12 may be opened or closed by a door 15. The door 15 may be rotatably coupled to the front surface of the cabinet 11. Further, a control panel 13 configured to display operation information of the washing machine 1 and receive an operation command may be provided in the front surface of the cabinet 11.

The tub 20 may be formed in a cylindrical shape having an open front surface. A main water supply port 21 configured to receive water from an external water source, a main drain port 22 configured to discharge water, and an inlet port 23 through which water is received from the sink 60 may be formed in the tub 20.

A guide gasket 26 configured to guide laundry put into the washing tub 30 via the inlet 12 may be formed between the inlet 12 of the cabinet 11 and the tub 20. A heater 19 configured to heat water may be formed at a lower inner side of the cabinet 11.

The washing tub 30 is rotatably provided in the tub 20 and accommodates laundry. The washing tub 30 may have a cylindrical shape having an opening 32 formed in a front surface thereof. A plurality of through holes 31 through which water in the tub 20 may flow may be formed in an outer circumferential surface of the washing tub 30. A lifter 33 capable of lifting laundry may be provided on an inner circumferential surface of the washing tub 30. When the washing tub is rotated, since the lifter 33 lifts and drops laundry using the above-described configuration, the laundry may be washed.

The driver 16 may include a motor 17 configured to convert an electric force into a mechanical rotational force, and a washing shaft 18 configured to transmit the rotational force generated by the motor 17 to the washing tub 30. The motor 17 may include a fixed stator 17*a*, and a rotor 17*b* configured to interact and rotate with the stator 17*a*.

The sink 60 is fixedly provided on the main body 10. The sink 60 includes a sink body 61 and a water tank 70 formed to be recessed inward from the sink body 61 to store water. Since an upper surface of the water tank 70 is open, a user may approach the water tank 70 through the open upper surface of the water tank 70.

The water tank 70 includes a soaking part 71 provided to soak laundry in water and a scrubbing part 72 provided to hand-wash laundry by scrubbing.

Further, the water tank 70 may include a front wall 75*a*, a rear wall 75*b*, a left wall 75*c*, and a right wall 75*d* extending upward from peripheries of the soaking part 71 and the scrubbing part 72. Accordingly, a water storage space is formed by the front wall 75*a*, the rear wall 75*b*, the left wall 75*c*, the right wall 75*d*, the soaking part 71, and the scrubbing part 72, and water may be stored in the soaking part 71 and the scrubbing part 72.

Each of the soaking part 71 and the scrubbing part 72 may be formed to be flat without a curve. A connector 73 may be provided between the soaking part 71 and the scrubbing part 72. The connector 73 may be obliquely formed.

The soaking part 71 may be located at a lower level than the scrubbing part 72. The soaking part 71 and the scrubbing part 72 may be formed to be approximately horizontal relative to each other, and may have a step. Accordingly, when water is supplied to the water tank 70, the soaking part 71 may be filled with the water, and scrubbing part 72 may then be filled with the water. Further, the water stored in the soaking part 71 may be deeper than the water stored in the scrubbing part 72.

As an example, water may be stored in the soaking part 71 so that laundry is entirely or almost submerged, and, in this case, the water may be stored in the scrubbing part 72 so that only a part of the laundry is submerged or water may not be stored in the scrubbing part 72.

Accordingly, a user may put laundry L in the water stored in the soaking part 71 to soak the laundry L (see FIG. 4), and may hand-wash the laundry L (see FIG. 5) by scrubbing the laundry L on the scrubbing part 72.

Friction protrusions 74 are formed on the scrubbing part 72 to hand-wash laundry by scrubbing. The friction protrusions 74 may have an appropriate shape which protrudes from the scrubbing part 72 to rub laundry, but the embodiment is not limited to the above-described shape of the friction protrusion 74.

The friction protrusions 74 may be formed on the soaking part 71 in addition to the scrubbing part 72. Accordingly, laundry may be scrubbed on the soaking part 71 to be hand-washed as necessary. However, the friction protrusions 74 on the scrubbing part 72 are not essential.

The embodiment is not limited to the arrangement of the soaking part 71 and the scrubbing part 72. That is, although the soaking part 71 is provided on the right side of the sink 60 and the scrubbing part 72 is provided on the left side of the sink 60 in the embodiment, the soaking part 71 and the scrubbing part 72 are not limited thereto and may be oppositely disposed and disposed in a front-rear direction.

Since the soaking part 71 and the scrubbing part 72 are provided in the sink 60 as described above, the sink 60 may provide soaking and hand-washing functions. When laundry is scrubbed on scrubbing part 72 to be hand-washed, since the sink 60 is fixed on the main body 10, the laundry may be sufficiently strongly scrubbed.

Further, when soaking laundry in the soaking part 71 is completed, the laundry may be moved to the scrubbing part 72 and hand-washed without a process of discharging the water in the sink 60.

While hand-washing laundry in the scrubbing part 72 or after hand-washing the laundry in the scrubbing part 72 is completed, the laundry may be moved to the soaking part 71 and then easily soaked or rinsed in water.

When the soaking or hand-washing of the laundry in the sink 60 is completed as described above, the laundry may be put into the washing tub 30 through the inlet 12 in the front of the main body 10 to perform main washing.

An auxiliary drain port 81 through which water in the sink 60 is discharged may be formed in the soaking part 71.

The washing machine 1 includes a water supply device 40 configured to supply water to the tub 20 and the sink 60.

The water supply device 40 may include a main water supply pipe 42 configured to supply water to the tub 20, an auxiliary water supply pipe 43 configured to supply water to the sink 60, a main water supply valve 44 configured to open or close the main water supply pipe 42, an auxiliary water supply valve 45 configured to open or close the auxiliary water supply pipe 43, a main detergent inlet 46 through which a detergent is put into the water supplied to the tub 20, and an auxiliary detergent inlet 47 through which a detergent is put into the water supplied to the sink 60.

The main water supply pipe 42 connects an external water supply pipe 41 and the tub 20. The main water supply pipe 42 may include a first main water supply pipe 42*a* configured to connect the main water supply valve 44 and the main detergent inlet 46, and a second main water supply pipe 42*b* configured to connect the main detergent inlet 46 and the main water supply port 21 of the tub 20.

The auxiliary water supply pipe 43 connects the external water supply pipe 41 and the sink 60. A nozzle 49 configured to introduce water to the sink 60 may be provided on an end portion of the auxiliary water supply pipe 43.

A bubble generator 48 configured to generate bubbles may be provided on the auxiliary water supply pipe 43. Accordingly, water including bubbles may be supplied to the sink 60.

The bubble generator 48 may include a venturi tube 48*a* having a cross sectional area which decreases and increases, and an air introduction pipe 48*b* connected to the venturi tube 48*a*. The air introduction pipe 48*b* may be connected to a portion having the smallest cross section of the venturi tube 48*a*. As the cross section of the venturi tube 48*a* decreases, a flow rate of water in the venturi tube 48*a* increases and pressure in the venturi tube 48*a* decreases, and accordingly, air is introduced through the air introduction pipe 48*b* and a bubble may be generated.

The main detergent inlet 46 may allow detergent to be put into the water supplied to the tub 20, and the auxiliary detergent inlet 47 may allow detergent to be put into the water supplied to the sink 60. The main detergent inlet 46 may be a drawer type inlet that is drawn from the main body 10 in a forward direction. The auxiliary detergent inlet 47 may be accessed from above. The auxiliary detergent inlet 47 may be provided behind the sink 60.

The washing machine 1 includes a drain device 50 configured to discharge water in the tub 20 and the sink 60.

The drain device 50 may include a main drain pipe 51 configured to discharge water in the tub 20, an auxiliary drain pipe 55 configured to discharge water in the sink 60, a drain pump 52 provided in the main drain pipe 51 to pump water, and a drain valve 56 configured to open or close the auxiliary drain port 81 and the auxiliary drain pipe 55.

The main drain pipe 51 may include a first main drain pipe 51*a* configured to connect the main drain port 22 of the tub 20 and the drain pump 52, and a second main drain pipe 51*b* extending from the drain pump 52 to the outside of the main body 10.

The auxiliary drain pipe 55 may be provided to connect the sink 60 and the tub 20. That is, one end of the auxiliary drain pipe 55 may be connected to the auxiliary drain port 81 of the sink 60, and the other end of the auxiliary drain pipe 55 may be connected to the inlet port 23 of the tub 20.

As described above, water discharged from the sink 60 may be supplied to the tub 20 to be recycled. The water discharged from the sink 60 to the tub 20 may be finally discharged to the outside of the main body 10 through the main drain pipe 51 by the drain pump 52 being operated.

The drain valve 56 opens and closes the auxiliary drain port 81 and the auxiliary drain pipe 55 to control the discharge of water in the sink 60. The drain valve 56 may be a manual valve manually opened or closed by a user. As an example, the drain valve 56 may be a pop-up valve configured to be moved upward to be opened when pressed and closed when pressed again. Alternatively, the drain valve 56 may be an electric valve operated by electricity, a motor, or the like.

The washing machine 1 may include an overflow pipe 59 configured to discharge oversupplied water when water in the sink 60 reaches a predetermined water level to prevent an overflow of the water in the sink 60.

One end of the overflow pipe 59 may be connected to an overflow hole 82 formed in the sink 60, and the other end of the overflow pipe 59 may be connected to the auxiliary drain pipe 55. Accordingly, when water in the sink 60 reaches the predetermined water level, the oversupplied water may be guided to the tub 20 through the overflow pipe 59 and the auxiliary drain pipe 55.

Unlike the embodiment, the one end of the overflow pipe 59 may be connected to the overflow hole 82, and the other end of the overflow pipe 59 may be connected to the main drain pipe 51. Therefore, water oversupplied into the sink 60 which exceeds the predetermined water level may be guided to the outside of the main body 10 through the overflow pipe 59 and the main drain pipe 51.

Second Embodiment

FIG. 6 is a side sectional view illustrating a schematic configuration of a washing machine according to a second embodiment of the present disclosure.

The washing machine according to the second embodiment of the present disclosure will be described with reference to FIG. 6. The same components as those of the above-describe embodiment may have identical reference numerals, and descriptions thereof will be omitted.

Like the above-described embodiment, a drain device 250 of a washing machine 200 discharges water in a sink 60 to a tub 20.

However, unlike the above-described embodiment, an auxiliary drain pipe 255 may not be directly connected to the tub 20, and may be connected to a main water supply pipe 42 configured to supply water to the tub 20. That is, one end of the auxiliary drain pipe 255 may be connected to an auxiliary drain port 81 of the sink 60, and the other end of the auxiliary drain pipe 255 may be connected to the main water supply pipe 42.

In the embodiment, the other end of the auxiliary drain pipe 255 is connected to a second main water supply pipe 42*b* of the main water supply pipe 42, but, unlike the embodiment, the other end may be connected to a first main water supply pipe 42*a*.

As described above, since the auxiliary drain pipe 255 is not directly connected to the tub 20 and is connected to the main water supply pipe 42, an inlet port 23 through which the tub 20 is connected to the auxiliary drain pipe 255 is not necessary.

Third Embodiment

FIG. 7 is a side sectional view illustrating a schematic configuration of a washing machine according to a third embodiment of the present disclosure.

The washing machine according to the third embodiment of the present disclosure will be described with reference to FIG. 7. The same components as those of the above-describe embodiments may have identical reference numerals, and descriptions thereof may be omitted.

Unlike the above-described embodiments, a drain device 350 of a washing machine 300 may discharge water in a sink 60 outside of a main body 10 instead of discharging the water to a tub 20.

To this end, one end of an auxiliary drain pipe 355 of the drain device 350 may be connected to an auxiliary drain port 81 of the sink 60, and the other end of the auxiliary drain pipe 355 may be connected to a main drain pipe 51.

In the embodiment, the other end of the auxiliary drain pipe 355 is connected to a first main drain pipe 51*a* of the main drain pipe 51, but, unlike the embodiment, the other end may be connected to a second main drain pipe 51*b*.

Further, unlike the embodiment, the one end of the auxiliary drain pipe 355 may be connected to the auxiliary drain port 81 of the sink 60, and the other end of the auxiliary drain pipe 355 may directly extend outward from the main body 10 instead of being connected to the main drain pipe 51. That is, the auxiliary drain pipe 355 and the main drain pipe 51 may be separately provided.

Due to the above-described configuration, water discharged from the sink 60 may not be supplied to the tub 20 to be recycled and may be directly discharged to the outside of the main body 10.

Fourth Embodiment

FIG. 8 is a perspective view illustrating a washing machine according to a fourth embodiment of the present disclosure. FIG. 9 is a view illustrating a sink cover separated from the washing machine in FIG. 8. FIG. 10 is a view illustrating an open state of the sink cover of the washing machine in FIG. 8.

The washing machine according to the fourth embodiment of the present disclosure will be described with reference to FIGS. 8 to 10. The same components as those of the above-describe embodiments may have identical reference numerals, and descriptions thereof may be omitted.

A washing machine 400 may include a sink cover 490 configured to cover an upper portion of a sink 60. The sink cover 490 may cover an open upper surface of a water tank 70 of the sink 60.

That is, the water tank 70 of the sink 60 may not be accessed when the sink cover 490 is closed, and the water tank 70 of the sink 60 may be accessed when the sink cover 490 is opened.

Since the sink cover 490 is formed of a transparent material, an inside of the sink 60 may be seen even when the sink cover 490 is closed.

The sink cover 490 may be coupled to a rear portion of the sink 60. The sink cover 490 may be tilted in a vertical direction. To this end, hinge shafts 491 may be provided on both sides of a rear end of the sink cover 490, and hinge shaft accommodators 462 into which the hinge shafts 491 are rotatably inserted may be provided at the sink 60.

A handle groove 492 may be formed in a front end of the sink cover 490 so that a hand may grasp the handle groove 492 and lift the sink cover 490 in a state in which the sink cover 490 is closed.

The sink cover 490 may be opened at an angle of approximately 90°. Since the sink cover 490 may be fixed in an open state, the sink cover 490 may perform a function of preventing water in the sink 60 from splashing rearward from the sink 60 when hand-washing or the like is performed in the sink 60.

Fifth Embodiment

FIG. 11 is a perspective view illustrating an exterior of a washing machine according to a fifth embodiment of the present disclosure. FIG. 12 is a view illustrating a tray separated from the washing machine in FIG. 11. FIG. 13 is a side sectional view illustrating a sink and the tray of the washing machine in FIG. 11. FIG. 14 is an enlarged view illustrating portion A in FIG. 13. FIG. 15 is an enlarged view illustrating portion B in FIG. 13.

The washing machine according to the fifth embodiment of the present disclosure will be described with reference to FIGS. 11 to 15. The same components as those of the above-describe embodiments may have identical reference numerals, and descriptions thereof may be omitted.

A washing machine 500 includes a sink 560 provided on a main body 10 and a tray 590 detachably mounted on the sink 560 such that laundry washed in the sink 560 is moved to an inlet formed in a front surface of the main body 10.

The sink 560 includes a sink body 561 and a water tank 570 formed to be recessed inward from the sink body 561 to store water.

The water tank 570 includes a soaking part 571 provided to soak laundry in water and a scrubbing part 572 provided to hand-wash laundry by scrubbing. Further, the water tank 570 may include a front wall 575*a*, a rear wall 575*b*, a left wall 575*c*, and a right wall 575*d* extending upward from peripheries of the soaking part 571 and the scrubbing part 572. Accordingly, a water storage space is formed by the front wall 575*a*, the rear wall 575*b*, the left wall 575*c*, the right wall 575*d*, the soaking part 571, and the scrubbing part 572, and water may be stored in the soaking part 571 and the scrubbing part 572.

The soaking part 571 may be formed to be flat without a curve. The soaking part 571 may be located at a lower level than the scrubbing part 572.

The soaking part 571 may be formed at a rear portion of the sink 560, and the scrubbing part 572 may be formed in front of the soaking part 571. The scrubbing part 572 may be downwardly inclined in a rearward direction. Therefore, a hand-washing operation of scrubbing the laundry on the scrubbing part 572 is easily performed.

According to the above-described configuration, when water is supplied to the water tank 570, the entire soaking part 571 is filled with the water at an initial stage and the scrubbing part 572 is gradually filled with the water from top to bottom according to an amount of the water.

Friction protrusions 574 may be formed on the scrubbing part 572 so that laundry is scrubbed to be hand-washed. The friction protrusion 574 may have an appropriate shape which protrudes from the scrubbing part 572 to rub laundry, but the embodiment is not limited to the above-described shape of the friction protrusions 574.

An auxiliary drain port 581 through which water in the sink 560 is discharged may be formed in the soaking part 571. A drain valve 556 may be provided in the auxiliary drain port 581. A nozzle 549 configured to introduce water to the sink 560 may be provided in any one wall selected from the front wall 575*a*, the rear wall 575*b*, the left wall 575*c*, and the right wall 575*d*. An auxiliary drain pipe 555 may be connected to the auxiliary drain port 581.

The tray 590 may be provided to cover a part of the water tank 570 of the sink 560. As an example, the tray 590 may be provided to cover the scrubbing part 572 of the sink 560. Accordingly, when the tray 590 is mounted on the sink 560, the tray 590 may perform a function of the scrubbing part 572 of the sink 560.

Friction protrusions 594 may be formed on the tray 590 to hand-wash laundry by scrubbing the laundry on the tray 590.

A laundry through port 596 may be formed in the tray 590 so that laundry may be moved between the tray 590 and the sink 560. The laundry through port 596 may be formed in a rear end of the tray 590.

A seat flange 595 is formed on an edge of the tray 590 to seat the tray 590 on the sink 560, and a seat portion 585 on which the seat flange 595 is seated may be formed at the sink 560.

The tray 590 may include a sliding prevention protrusion 597 to prevent laundry from sliding in the sink 560. The sliding prevention protrusion 597 may protrude downward from the rear end of the tray 590.

The sink 560 may include a restrainer 586 which interferes with the sliding prevention protrusion 597. The restrainer 586 may include a restraining groove 586*a* into which the sliding prevention protrusion 597 is inserted, and a restraining protrusion 586*b* protruding from a rear side of the sliding prevention protrusion 597.

A handle opening 598 may be formed in the tray 590 so that the tray 590 may be grasped by a hand and moved.

The tray 590 may include a buffer member 599 configured to prevent friction between a tray body 591 and the sink 560 and reduce impact on the sink 560 when the tray 590 is seated in the sink 560. The buffer member 599 may be formed of a rubber material and coupled to an edge of the tray body 591.

As described above, the tray 590 may perform a function of a scrubbing part in which laundry is scrubbed and hand-washed when it is mounted on the sink 560, and, when the laundry is moved to the inlet in the front surface of the main body 10 after hand-washing and soaking of the laundry are completed, the tray 590 may perform a function of a transportation container configured to accommodate and transport the laundry.

Sixth Embodiment

FIG. 16 is a perspective view illustrating an exterior of a washing machine according to a sixth embodiment of the present disclosure. FIG. 17 is a view illustrating a state in which a tray of the washing machine in FIG. 16 is mounted on a tray holder and a water tap is opened.

The washing machine according to the sixth embodiment of the present disclosure will be described with reference to FIGS. 16 and 17. The same components as those of the above-describe embodiments may have identical reference numerals, and descriptions thereof may be omitted.

A washing machine 600 includes a sink 660 provided on a main body 10 and a tray 690 detachably mounted on the sink 660 such that laundry washed in the sink 660 may be moved to an inlet formed in a front surface of the main body 10.

The sink 660 includes a sink body 661 and a water tank 670 formed to be recessed inward from the sink body 661 to store water.

The water tank 670 includes a soaking part 671 provided to soak laundry in water, and further includes a front wall 675*a*, a rear wall 675*b*, a left wall 675*c*, and a right wall 675*d* extending upward from a periphery of the soaking part 671. Accordingly, a water storage space is formed by the front wall 675*a*, the rear wall 675*b*, the left wall 675*c*, the right wall 675*d*, and the soaking part 671, and water may be stored in the soaking part 671.

The soaking part 671 may be formed to be flat without a curve. An auxiliary drain port 681 through which water in the sink 660 is discharged may be formed in the soaking part 671. A drain valve 656 may be provided in the auxiliary drain port 681.

An air jet injector 682 configured to inject air into the water stored in the soaking part 671 may be provided above the soaking part 671. The air jet injector 682 may include air jet injection ports 683. Since air is injected into the water stored on the soaking part 671, an effect of laundry being soaked may be improved.

A water tap 649 configured to supply water to the water tank 670 may be provided at a rear portion of the sink 660. The water tap 649 may include a water tap body 651 extending to the water tank part 670 from the sink body 661, and a water tap cover 650 configured to cover an upper surface of the water tap body 651. The water tap cover 650 may be rotatably coupled to the water tap body 651 by a hinge portion 655.

A detergent cartridge 653 configured to store a detergent may be mounted on the water tap body 651. To this end, a cartridge mounting portion 652 on which a detergent cartridge 653 is mounted may be provided in the water tap body 651.

The detergent cartridge 653 includes a detergent container 654 configured to accommodate the detergent. The detergent container 654 may be provided to have an open front portion. A user may mount the detergent cartridge 653 on the cartridge mounting portion 652 after putting various liquid detergents, powder detergents, and conditioners in the detergent container 654.

When water is supplied to the water tap 649 after the detergent cartridge 653 in which the detergent is stored is mounted on the water tap 649, the water and the detergent may be mixed in the water tap 649. Accordingly, the water mixed with the detergent may be supplied to the water tank 670.

The sink 660 may include a tray holder 687 configured to hold the tray 690. The tray holder 687 may be formed at one side of the sink 660.

The tray holder 687 is inserted into a handle opening 698 of the tray 690, and the tray 690 may be held by the tray holder 687.

The tray holder 687 may be rotatably provided in the sink 660 to be normally hidden and exposed when used. That is, the tray holder 687 may be normally hidden, as shown in FIG. 16, and may rotate in one direction to be exposed to the outside, as shown in FIG. 17.

The sink 660 may include a holder container 689 configured to accommodate the tray holder 687, and the tray holder 687 may be accommodated and hidden in the holder container 689. A handle 688 which is grasped to rotate the tray holder 687 may be formed on the tray holder 687.

The tray 690 may be provided to cover a part of the water tank 670 of the sink 660. The tray 690 may perform a function of a scrubbing part in a state in which it is mounted on the sink 660. Friction protrusions 694 may be formed on the tray 690 to hand-wash laundry by scrubbing.

A laundry through port 696 may be formed in the tray 690 so that laundry may be moved between the tray 690 and the sink 660. The laundry through port 696 may be formed in a rear end of the tray 690.

The tray 690 may include a sliding prevention protrusion 697 to prevent laundry from sliding in the sink 660. The sliding prevention protrusion 697 may protrude downward from the rear end of the tray 690.

The sink 660 may include a restrainer 686 which interferes with the sliding prevention protrusion 697.

Seventh Embodiment

FIG. 18 is a perspective view illustrating a washing machine according to a seventh embodiment of the present disclosure. FIG. 19 is a view illustrating a tray and a guide member separated from the washing machine in FIG. 18. FIGS. 20 to 22 are views illustrating a rotating operation of the tray of the washing machine in FIG. 18.

The washing machine according to the seventh embodiment of the present disclosure will be described with reference to FIGS. 18 to 22. The same components as those of the above-describe embodiments may have identical reference numerals, and descriptions thereof may be omitted.

A washing machine 700 includes a sink 760 provided on a main body 10 and a tray 790 detachably mounted on the sink 760 such that laundry washed in the sink 760 is moved to an inlet formed in a front surface of the main body 10.

The sink 760 includes a sink body 761 and a water tank 770 formed to be recessed inward from the sink body 761 to store water.

The water tank 770 includes a soaking part 771 provided to soak laundry in water, and a scrubbing part 772 provided to hand-wash laundry by scrubbing. Further, the water tank 770 may include a rear wall 775*a*, a left wall 775*b*, and a right wall 775*c* extending upward from peripheries of the soaking part 771 and the scrubbing part 772. Accordingly, a water storage space is formed by the rear wall 775*a*, the left wall 775*b*, the right wall 775*c*, the soaking part 771, and the scrubbing part 772, and water may be stored in the soaking part 771 and the scrubbing part 772.

The soaking part 771 may be formed to be flat without a curve. The soaking part 771 may be formed at a rear portion of the sink 760, and the scrubbing part 772 may be formed in front of the soaking part 771. The scrubbing part 772 may be downwardly inclined in a rearward direction.

According to the above-described configuration, when the water is supplied to the water tank 770, the entire soaking part 771 is filled with the water at an initial stage, and the scrubbing part 772 is gradually filled with the water from the bottom to the top according to an amount of the water.

Friction protrusions 774 may be formed on the scrubbing part 772 to hand-wash laundry by scrubbing. The friction protrusion 774 may have an appropriate shape which protrudes from the scrubbing part 772 to rub laundry, but the embodiment is not limited to the above-described shape of the friction protrusion 774.

The friction protrusions 774 may be formed on the soaking part 771 so that hand-washing may be performed on the soaking part 771 as necessary.

A nozzle 749 configured to introduce water to the sink 760, an overflow hole 782 configured to discharge water which exceeds a predetermined water level, and an auxiliary detergent inlet 747 through which a detergent is introduced may be provided in any one wall selected from the rear wall 775*a*, the left wall 775*b*, and the right wall 775*c* of the sink 760.

The tray 790 may be provided to cover the entire water tank 770 of the sink 760. Accordingly, the tray 790 may have the same shape as the water tank 770 of the sink 760. That is, the tray 790 may include a soaking part 791, a scrubbing part 792, a rear wall 793*a*, a left wall 793*b*, a right wall 793*c*, and the like.

When the tray 790 is mounted on the sink 760, the laundry may be soaked and hand-washed on the tray 790. To this end, a plurality of water holes 796 may be formed in the tray 790 so that water passes through the plurality of water holes 796, and friction protrusions 794 may be formed on the soaking part 791 and the scrubbing part 792.

A seat flange 795 is formed on an edge of the tray 790 so that the tray 790 is seated on the sink 760, and a seat portion 785 on which the seat flange 795 is seated may be formed in the sink 760.

A handle opening 798 may be formed in the tray 790 so that the tray 590 may be gripped.

As described above, the tray 790 may perform a function of a soaking part in which laundry is soaked and a scrubbing part in which laundry is scrubbed and hand-washed instead of the sink 760 when the tray 790 is mounted on the sink 760, and the tray 790 may perform a function of a transportation container configured to accommodate and transport laundry when the laundry is moved to an inlet in a front portion of the main body 10 after hand-washing is completed.

Meanwhile, the tray 790 may be provided in the sink 760 to be vertically tiltable with respect to a tilt axis X, and may be provided to be rotatable with respect to a rotational axis Y perpendicular to the tilt axis X.

To this end, the washing machine 700 may include a guide member 800 configured to guide the rotation of the tray 790.

The guide member 800 may include a rotational pin accommodator 801 having a receiving groove 802 to which a rotational pin 799 rotatably and detachably provided at a rear portion of the tray 790 is coupled, and tilting pins 803 rotatably coupled to tilting pin accommodators 787 of the sink 760.

According to the above-described configuration, the tray 790 may be tilted in a direction C with respect to the tilt axis X, as shown in FIG. 20, the tray 790 may be rotated in a direction D with respect to the rotational axis Y, as shown in FIG. 21, and the tray 790 may be rotated in a direction E opposite the direction C with respect to the tilt axis X, as shown in FIG. 22, and therefore, the tray 790 may be rotated by 180°.

According to the above-described configuration, when laundry is put into the water tank 770 of the sink 760 and soaked, the tray 790 may be rotated 180° to cover the water tank 770 of the sink 760.

The invention claimed is:

1. A washing machine comprising:

a main body in which an inlet is formed in a front portion thereof;

an outer tub provided inside the main body, the outer tub having a cylindrical shape and comprising an inlet port on an outer circumferential of the outer tub;

a washing tub rotatably provided inside the outer tub; and a sink provided on the main body and having a water tank formed to be recessed to store water, wherein a bottom surface of the water tank includes:

a soaking part in which laundry is soaked, the soaking part formed to have a flat soaking surface, and a scrubbing part on which laundry is scrubbed and hand-washed, the scrubbing part formed to have a flat scrubbing surface approximately parallel relative to the flat soaking surface; and a drain device configured to control a discharge of water stored in the water tank to the inlet port of the outer tub, the drain device including:

an auxiliary drain port provided in the water tank, and an auxiliary pipe fluidly communicating the auxiliary drain port and the inlet port of the outer tub.

2. The washing machine of claim 1, wherein the soaking part is located at a lower level than the scrubbing part.

3. The washing machine of claim 1, wherein the scrubbing part is formed to be inclined.

4. The washing machine of claim 3, wherein the scrubbing part is downwardly inclined from a front side of the main body to a rear side of the main body.

5. The washing machine of claim 1, wherein the soaking part is provided at a rear side of the sink, and the scrubbing part provided at a front side of the sink.

6. The washing machine of claim 1, wherein the soaking part is provided at one side of a left side and a right side of the sink, and the scrubbing part is provided at the other side thereof.

7. The washing machine of claim 1, wherein a friction protrusion is formed on the scrubbing part.

8. The washing machine of claim 1, wherein a friction protrusion is formed on the soaking part.

9. The washing machine of claim 1, wherein the sink is fixedly provided on the main body.

10. The washing machine of claim 1, wherein the drain device further includes a drain valve configured to open or close the auxiliary pipe.

11. The washing machine of claim 1, further comprising an overflow pipe configured to discharge water which exceeds a predetermined water level in the sink.

* * * * *